US007433485B1

(12) United States Patent
Diedrich et al.

(10) Patent No.: US 7,433,485 B1
(45) Date of Patent: Oct. 7, 2008

(54) SHALLOW SPEAKER

(75) Inventors: Brad Michael Diedrich, Monroe, WI (US); Chad A. Kautz, Winslow, IL (US)

(73) Assignee: Mitek Corp., Inc., Phoenix, AZ (US)

( * ) Notice: Subject to any disclaimer, the term of this patent is extended or adjusted under 35 U.S.C. 154(b) by 0 days.

(21) Appl. No.: 12/030,861

(22) Filed: Feb. 13, 2008

Related U.S. Application Data

(60) Provisional application No. 61/019,366, filed on Jan. 7, 2008.

(51) Int. Cl.
*H04R 11/02* (2006.01)

(52) U.S. Cl. ..... 381/404; 381/423

(58) Field of Classification Search ..... 381/150, 381/396, 398, 404, 423, 431, 432; 181/171, 181/172, 173, 174
See application file for complete search history.

(56) References Cited

U.S. PATENT DOCUMENTS

| | | | |
|---|---|---|---|
| 5,734,132 | A | 3/1998 | Proni |
| 6,095,280 | A | 8/2000 | Proni |
| 6,501,844 | B2 | 12/2002 | Proni |
| 6,672,423 | B2 | 1/2004 | Kato |
| 6,879,700 | B2 | 4/2005 | Matsudo et al. |
| 7,185,735 | B2 | 3/2007 | Sahyoun |
| 7,197,154 | B2 | 3/2007 | Sahyoun |
| 7,203,333 | B2 | 4/2007 | Funahashi et al. |
| 7,209,570 | B2 | 4/2007 | Funahashi et al. |
| 7,225,895 | B2 | 6/2007 | Sahyoun |
| 7,292,707 | B2 | 11/2007 | Kreitmeier et al. |
| 2002/0071588 | A1 | 6/2002 | Proni |
| 2002/0150275 | A1 | 10/2002 | Guenther |
| 2003/0231784 | A1 | 12/2003 | Kuze et al. |
| 2004/0076309 | A1 | 4/2004 | Sahyoun |
| 2004/0165764 | A1 | 8/2004 | Kreitmeier et al. |
| 2005/0141746 | A1 | 6/2005 | Kobayashi et al. |
| 2005/0276435 | A1 | 12/2005 | Watanabe |
| 2006/0018500 | A1 | 1/2006 | Watanabe |
| 2006/0120554 | A1 | 6/2006 | Watanabe |
| 2006/0215871 | A1 | 9/2006 | Funahashi et al. |
| 2006/0245615 | A1 | 11/2006 | Funahashi |
| 2007/0127768 | A1 | 6/2007 | Horigome et al. |
| 2007/0177757 | A1 | 8/2007 | Funahashi et al. |

*Primary Examiner*—Brian Ensey
(74) *Attorney, Agent, or Firm*—Keith L. Jenkins

(57) ABSTRACT

A novel shallow speaker has a novel spidercone coaxial with and optionally having a radially inner spidercone flange suspended in a circumferential adhesive well affixed to the former. An inner rearward flange of the flat annular diaphragm is suspended in the circumferential adhesive well and the well is filled with epoxy. The spidercone has a frustroconical portion having a minimum radius smaller than the maximum magnet assembly radius and a maximum radius greater than the maximum magnet assembly radius. The spidercone has a spider portion integral with the larger end of the frustroconical portion and attachable to the basket by a tangential flange. The tinsel is interwoven with the spidercone in a way that reduces the risk of breaking and shorting. The diaphragm is substantially flat and coplanar with the top edge of the narrow surround when at rest.

20 Claims, 11 Drawing Sheets

SHALLOW SPEAKER

RELATED APPLICATIONS

This application claims the benefit of U.S. Provisional Application No. 61/019,366 filed Jan. 7, 2008.

FIELD OF THE INVENTION

The present invention relates to shallow loudspeakers, particularly loudspeakers in the low-frequency audible range (woofers and sub-woofers). More particularly, the present invention relates to a novel speaker design for maintaining the excursion capability of the speaker while reducing its depth dimension.

BACKGROUND OF THE INVENTION

A conventional loudspeaker, or "speaker", as used herein, may use a moveable diaphragm, or "speaker cone" to produce sound. Some speaker cones have radially symmetrical curvature, but may have shape variations (some are almost flat) that vary the geometry of the diaphragm from a strict geometric cone. The speaker cone is moved by a former, which also supports the voice coil. The former is attached to the speaker cone. The voice coil, which rests in the magnetic field of a magnet assembly, receives an audio-encoded electrical signal, or "audio signal", which causes varying current in the voice coil. By interaction of the voice coil current with the magnetic field of the magnet assembly, sound-producing movement of the former and speaker cone results. The voice coil is constrained to one-dimensional motion, perpendicular to the base plane of the speaker cone, by a flexible support structure called a "spider." The magnet assembly may comprise a magnetically permeable pole piece, a permanent magnet, and a magnetically permeable top plate. The pole piece may feature an annular groove, or "air gap," to permit motion of the voice coil deeper into the magnetic field of the magnet assembly. The speaker cone is supported at its widest perimeter by a flexible suspension, or "surround", which, in turn, is supported by a structure called a "basket." The top plate of the magnet assembly and the spider are also connected to the basket. An opening in the speaker cone at its center may be covered with a dust cap, which reduces the amount of dust that may affect voice coil motion in the annular groove. At least a portion of the surround conventionally has a semicircular or sinusoidal transverse cross-section.

Shallow speakers, as the term is commercially used, are speakers with reduced depths. The depth of a speaker is the maximum dimension of the speaker parallel to the longitudinal axis of motion of the speaker. The advantage of a shallow speaker is that it may be used in mounting environments where thicker speakers may not be suitable. For example, shallow speakers may be used in conjunction with flat screen television sets, automobiles, or audio systems for small apartments. The reduced depth of shallow speakers can come at the cost of reduced excursion for the diaphragm.

The amount of sound produced by a speaker is proportional to the air volume displaced by the diaphragm in its axially oscillatory motion. The volume displacement, in turn, is determined as a function of the area of the plane of the diaphragm at its largest point and by the maximum distance it can travel from a quiescent state, called the speaker's "excursion." The designer must strike a balance between the size of the excursion, enabling more sound if the excursion is larger, and the depth of the speaker. Accordingly, the aim of shallow speaker design is to find ways to maximize volume displacement while maintaining high sound quality and minimizing depth.

Significant problems arise from the use of glue in the manufacture of speakers. The glue joints age faster than other connections. The aging takes the form of strain hardening and stress fracture in the glue joint, resulting in failure of the speaker. Some glue joints are riskier than others. High-risk glue joints are glue joints that connect two rigid members in contact in a moving system, or connect more than two members, whether rigid or flexible.

The cost of manufacture is another important consideration in speaker design. Intricate manufacture means expensive manufacture, quality risks, and reliability risks. Generally, designs having many parts or features will require more intricacy in manufacture than designs having fewer parts. The number of attachments that must be made between the parts is also a contributor to manufacturing cost. Alignment is also part of the manufacturing problem. The more separate pieces that have to be aligned about the longitudinal axis of speaker motion, the more difficult and expensive the manufacturing of the speaker becomes.

There have been attempts by others to accomplish shallow speakers without sacrifice of excursion. Proni (U.S. Pat. Nos. 5,734,132, 6,095,280, and 6,501,844) employs a substantially cylindrical tubular suspension, of greater diameter than the magnet assembly, attached between a spider and a diaphragm. Proni's approach requires intricate manufacture and high-risk glue joints. Proni does not provide vents in the tubular suspension itself, but provides an optional ring (which you really need!) between the diaphragm and the tubular suspension, which provides vents. Proni also teaches rigid-to-rigid glue joints.

Funahashi (U.S. Pat. Nos. 7,203,333, 7,209,570, and published U.S. patent applications 20060215871, 20060245615, 20070177757) adopted a principle of operation of reducing the effect of non-linearity in the surround by using an inverted second edge, or surround, for the rear suspension, in place of a spider. Funahashi's approach requires intricate manufacture and high-risk glue joints. Funahashi's second edges require more clearance than spiders, and the stiffness is not progressive, as with a spider. Funahashi's use of the inverted surround requires a suspension holder between the second edge and the bobbin, or former, to reach across the space that a longer spider would otherwise occupy, and to avoid the magnet assembly. Funahashi's diaphragm and suspension holder are rigid and are glued to the rigid bobbin and, in some embodiments, to each other. Funahashi's approach requires a glue joint between the second edge and the rigid suspension holder, and limits the damping action to the frequencies affected by the edges. Funahashi uses the rigid inner portion of his suspension holder to support the diaphragm in a triangular structure with the bobbin that apparently attempts to compensate for the propensity of second edges to flop about, rather than firmly center the bobbin and voice coil. Funahashi's last U.S. application indicates that the success anticipated for his earlier work did not fully materialize.

Sahyoun (U.S. Pat. Nos. 7,185,735, 7,197,154, 7,225,895 and U.S. Patent published application 20040076309) also adopted a principle of operation of reducing the effect of non-linearity in the surround by using an inverted second edge, or surround, for the rear suspension, in place of a spider. Sahyoun's speakers also require intricate manufacture and high-risk glue joints. Sahyoun's outer V-shaped diaphragm flange has two surrounds attached. Sahyoun's second edge also limits the damping action to the frequencies affected by the edges. Sahyoun also teaches a spider glued to an apex of a V-shaped diaphragm optionally with an additional diaphragm overlaying and glued to the V-shaped diaphragm. Yet another embodiment of Sahyoun teaches a vertically downward flange of a diaphragm.

Kreitmeir (Published U.S. Patent Application 20040165764) also teaches inverted opposed edges for improving linearity as well as a support structure to improve the rigid joint created by the diaphragm and the bead mount between the bobbin and the inner edge. Kreitmeier's speakers also require intricate manufacture and high-risk glue joints, as well as additional power to move the mass of the support structure.

Horigome (Published U.S. Patent Application 20070127768) also teaches inverted opposed edges for improving linearity. Horigome teaches a rigid drive cone glued between the inner edge and the rigid bobbin, with the rigid dust cap and the rigid diaphragm glued to an apex of the rigid drive cone. Horigome forms a gas-tight space with his drive cone, frame, edges and diaphragm to create an air spring. Horigome's speakers require intricate manufacture and very-high-risk glue joints, especially at the juncture of the cone, dust cap, and diaphragm.

Kato (U.S. Pat. No. 6,672,423) teaches an inverted rigid V-shaped cone glued between the rigid bobbin and two parallel spiders with the rigid diaphragm connected to the inverted V-shaped cone at the apex. A cone paper extends from the surround to attach to the forward spider. Kato's speakers require intricate manufacture and high-risk glue joints.

Kobayashi (Published US Patent Application 20050141746) also teaches inverted opposed edges for improving linearity. Kobayashi teaches a rigid drive cone glued between the inner edge and the rigid bobbin, with the rigid dust cap and the rigid diaphragm glued to an apex of the rigid drive cone. Kobayashi forms a gas-tight space with his drive cone, frame, edges, and diaphragm to create an air spring. Kobayashi's speakers require intricate manufacture and very-high-risk glue joints, especially at the juncture of the cone, dust cap, and diaphragm.

Watanabe (Published U.S. Patent Applications 20050276435, 20060018500, and 20060120554) teaches a rigid stepped cylindrical connection member attached to two parallel spiders. Watanabe's rigid connection member is incredibly intricate to manufacture, some versions appearing all but impossible to die press. Watanabe uses rigid metallic terminal members secured in recesses in the sides of the connection member to conduct the audio signal from a tinsel to the voice coil leads. The rigid connection member is glued to the underside of the rigid diaphragm, in the vicinity of the front end of the voice coil bobbin, by a circumferential bead of glue. Watanabe's speakers require extremely intricate manufacture and very-high-risk glue joints, especially at the juncture of the connecting member and diaphragm.

The inventors have recognized a need for a shallow speaker that is simple to manufacture that suffers no sacrifice of excursion, power, and no loss of sound quality. The inventors have also recognized a need for a fully integrated new design for a shallow speaker. The inventors have also recognized the advantage of minimizing the number of glue joints in the design, especially high-risk glue joints. In order to meet those needs, and to solve related problems, the inventors have developed the novel shallow speaker of the present invention.

OBJECTS AND FEATURES OF THE INVENTION

A primary object and feature of the present invention is to provide a shallow speaker without sacrificing displacement volume. It is a further object and feature of the present invention to provide such a speaker having a novel spidercone. It is a further object of the invention to provide an integral spidercone that has a spider portion and a frustroconical portion. It is a further object of the invention to provide a frustroconical portion that, in turn, has a right frustroconical web and an integral annular portion that partially closes off the smaller, forward end of the right frustroconical web. It is a further object of the invention to provide a frustroconical portion having a minimum radius less than the radius of the magnet assembly and a maximum radius larger than the magnet assembly radius. It is yet another object of this invention to provide a spidercone with a tinsel interwoven in the spidercone. It is yet another object and feature of the present invention to provide a narrow surround with an integral gasket and forwardly angled radially inner surround flange. It is still yet another object and feature of the present invention to provide such a shallow speaker having a diaphragm having a front surface at rest in the same plane as the front edge of the surround. A further objective of the present invention is to provide a radially outer circumferential adhesive well proximate the front end of the former, allowing easier centering during assembly by suspending an inner circumferential diaphragm flange and/or a radially inner circumferential spidercone flange in epoxy, which hardens after alignment, without requiring contact between the flanges and the walls of the adhesive well. A further primary object and feature of the present invention is to provide such a speaker that is efficient, inexpensive, and handy. Other objects and features of this invention will become apparent with reference to the following descriptions.

SUMMARY OF THE INVENTION

In accordance with a preferred embodiment hereof, this invention provides a shallow speaker that can be assembled to employ a magnet assembly having a longitudinal axis and radial symmetry about such longitudinal axis, such magnet assembly having a magnet assembly maximum radius, the shallow speaker including a spidercone, wherein the spidercone includes a spider portion and a frustroconical subcone portion formed integrally with the spider portion.

Moreover, it provides that the frustroconical subcone portion includes a right frustroconical web and an integral flexible annular portion. Additionally, it provides that the right frustroconical web includes a radially outer surface, a front circular end having a front-end radius, and a rear circular end having a rear-end radius, that the front-end radius is smaller than the rear-end radius, but not necessarily smaller than such magnet assembly maximum radius. Additionally, it provides that the annular portion is integral with the front circular end, interior to the front circular end, partially closing the front circular end, having a rear surface and a front surface, and having an inner radius that is the minimum radius of the frustroconical subcone portion and is the spidercone minimum radius, wherein the spidercone minimum radius is less than such magnet assembly maximum radius. The spider portion, the right frustroconical web, and the flexible annular portion are not made integral by connecting any two of the spider portion, the right frustroconical web, and the flexible annular portion.

Also, it provides a shallow speaker including a spidercone having a right frustroconical web, wherein the right frustroconical web comprises a half-cone angle of at least three degrees. Also, it provides a shallow speaker including a spidercone having a right frustroconical web, wherein the right frustroconical web comprises a plurality of openings.

Additionally, the spidercone includes a plurality of rolls and a tangential radially outer circumferential attachment flange terminating an outermost roll of said plurality of rolls, wherein the tangential radially outer circumferential attachment flange is inclined at an angle tangential to the outermost roll.

Further, the present invention provides a shallow speaker including tinsel and a spidercone having a spider tinsel opening in the spider portion of the spidercone, the spider tinsel opening sized, shaped, and arranged to permit said tinsel to be threaded through the spider tinsel opening. Yet further, the spider portion includes a tangential radially outer circumferential attachment flange, the shallow speaker including a basket sized, shaped, and arranged to couple to the spidercone and to support the spidercone, the basket having an interior basket surface portion inclined to be parallel to the tangential radially outer circumferential attachment flange when the spidercone is coupled to the basket.

The spidercone is formed by a process that includes the step of providing a spidercone die. The process may additionally include providing a first sheet of cotton-nomex fabric having a first weave, a second sheet of cotton-nomex fabric having a second weave, resin, and a hardening adhesive; assembling a layered composite comprising, in order: the first sheet of cotton-nomex fabric and the second sheet of cotton-nomex fabric, wherein the first weave and the second weave are not parallel when layered; impregnating the layered composite with a first dose of resin; pressing said resin-impregnated layered composite in the spidercone die; releasing said die-pressed, resin-impregnated layered composite from the spidercone die; applying a plurality of doses of hardening adhesive to the right frustroconical web; and creating a spider tinsel opening in the spider portion and a cone tinsel opening in said right frustroconical web.

The shallow speaker further includes a substantially flat annular diaphragm having a diaphragm front surface and a diaphragm rear surface and a surround, wherein the surround includes a front edge defining a surround front edge plane and wherein the diaphragm is positioned, in a quiescent state of the shallow speaker, to have the diaphragm front surface substantially coplanar with the front edge plane. Further, the diaphragm has an integral and radially outer circumferential diaphragm flange angled rearward from the front annular surface at a first angle, the surround further includes a radially inner surround flange angled forward from a plane parallel to said front surface at the first angle to be substantially parallel to the radially outer circumferential diaphragm flange, and the radially outer circumferential diaphragm flange and the radially inner surround flange are operable to be adhesively coupled.

The shallow speaker also includes a former coaxially aligned with such magnet assembly, the former including: a right circular cylindrical web, a front end proximate the diaphragm, and a rear portion at least partially extendable into such magnet assembly and a radially outer circumferential adhesive well fixed to said former proximate the front end. The invention further provides that, wherein the spidercone comprises a radially inner circumferential spidercone flange angled rearward at a second angle, the radially inner circumferential spidercone flange sized shaped, and arranged to extend into the radially outer circumferential adhesive well.

Further, the diaphragm has an integral and radially inner circumferential diaphragm flange angled rearward from the diaphragm front surface at a second angle, and sized, shaped, and arranged to extend into the radially outer circumferential adhesive well. The invention further provides that at least a portion of the front annular surface of the spidercone is coupled to at least a portion of the diaphragm rear surface The shallow speaker also includes a spidercone that includes a spider tinsel opening, a cone tinsel opening, and a tinsel interwoven through the spidercone. The tinsel interwoven through the spidercone includes an extension of the tinsel through the spider tinsel opening and over a portion of the radially outer surface of the right frustroconical web; a further extension of the tinsel radially inward through the cone tinsel opening, proximate the rear annular surface of the annular portion; and a further extension of the tinsel a distance sufficient to allow, during speaker assembly, for the tinsel to be physically coupled to a former and electrically coupled to a voice coil coupled to the former. Further the invention provides a first tinsel portion affixed to the portion of the radially outer surface of the right frustroconical web; and a second tinsel portion affixed to a portion of the rear annular surface of the annular portion of the spidercone.

In accordance with another preferred embodiment, this invention provides a shallow speaker with a magnet assembly having a longitudinal axis and radial symmetry about the longitudinal axis, the magnet assembly including a magnet assembly maximum radius, a magnet, and an air gap. This embodiment further provides a former, including a right circular cylindrical web, a front end, vents, and a rear portion. And further provides a circumferential adhesive well, wherein the circumferential adhesive well is affixed to the former proximate the front end or is integral with the former proximate the front end, and further wherein the rear portion of the former is at least partially positionable within the air gap. And yet further includes a spidercone oriented coaxially with said magnet assembly wherein said spidercone comprises a spider portion and a frustroconical subcone portion formed integrally with said spider portion.

And further includes a substantially flat annular diaphragm oriented coaxially with said magnet assembly and further including: a diaphragm front surface; a diaphragm rear surface; an integral and radially outer circumferential diaphragm flange angled rearward from the diaphragm front surface at a first angle; an integral and radially inner circumferential diaphragm flange angled rearward from the diaphragm front surface at a second angle sized, shaped, and arranged, to extend into said radially outer circumferential adhesive well (without touching the inner surfaces of the circumferential adhesive well); and having a notch sized, shaped, and arranged to allow a tinsel to be threaded through said notch. Also included is a surround, including: a front edge defining a plane, wherein the diaphragm is positioned, in a quiescent state of the shallow speaker, to have the diaphragm front surface substantially coplanar with the plane of the front edge of the surround and a radially inner surround flange angled forward from a plane parallel to the diaphragm front surface at the first angle to be substantially parallel to the radially outer circumferential diaphragm flange. And further including: a basket supporting the magnet assembly, the spidercone, and the surround.

Also, the present invention provides that the spidercone includes a spider portion and a frustroconical subcone portion integral with the spider portion. The frustroconical subcone portion further includes a right frustroconical web integral with a flexible annular portion. The right frustroconical web includes a radially outer surface, a front circular end having a front-end radius, a rear circular end having a rear-end radius, wherein the front-end radius is smaller than the rear-end radius and the rear-end radius is larger than such magnet assembly maximum radius. The annular portion of the spidercone is integral with the front circular end, interior to said front circular end, partially closing said front circular end, has a rear surface and a front surface and has an inner radius that is the minimum radius of the frustroconical subcone portion and is the minimum radius of the spidercone, wherein the minimum radius of the spidercone is less than such magnet assembly maximum radius. Further, the spider portion, the right frustroconical web, and the annular portion are not made integral by connecting the spider portion, the right frustroconical web, and the annular portion.

The spider portion of the spidercone includes a plurality of rolls, further including an outermost roll and an innermost roll, wherein the innermost roll terminates tangential to the right frustroconical web; a tangential radially outer circumferential attachment flange integral with and terminating the outermost roll of the plurality of rolls, the tangential radially outer circumferential attachment flange extending tangentially from the outermost roll; and a spider tinsel opening. The shallow speaker also includes a basket sized, shaped, and arranged to couple to the spidercone and to support the spidercone, the basket having an interior basket surface portion inclined to be parallel to the tangential radially outer circumferential attachment flange when the spidercone is coupled to the basket.

Further, the spidercone includes at least one opening in the right frustroconical web. And further, the spidercone comprises a spidercone-die-pressed layered composite further comprising cotton-nomex fabric, resin, and hardening adhesive.

In accordance with another preferred embodiment hereof, this invention provides a shallow speaker that is the combination of: 1) a magnet assembly having a longitudinal axis and radial symmetry about the longitudinal axis, the magnet assembly having a magnet assembly maximum radius, a magnet, and an air gap; 2) a former having a front end, a rear portion, vents, and a radially exterior surface; a circumferential adhesive well, affixed to the radially exterior surface of the former, proximate the front end; 3) a spidercone oriented coaxially with the magnet assembly wherein said spidercone comprises a spider portion; and a frustroconical subcone portion formed integrally with said spider portion, wherein the spidercone includes: a spider portion, including: a plurality of rolls, a tangential, radially outer, circumferential attachment flange terminating an outermost roll of the plurality of rolls, and a spider tinsel opening; a frustroconical subcone portion formed integrally with the spider portion, wherein the frustroconical subcone portion includes: a right frustroconical web further including: a front circular end having a front-end radius; a rear circular end having a rear-end radius, wherein: the front-end radius is smaller than the rear-end radius; the rear-end radius is larger than the magnet assembly maximum radius; a half-cone angle of at least three degrees; and at least one opening; and an annular portion integral with the front circular end; interior to the front circular end, partially closing the front circular end, having an inner radius that is the minimum radius of the frustroconical subcone portion and is the minimum radius of the spidercone, wherein the minimum radius of the frustroconical subcone portion is less than the magnet assembly maximum radius; wherein the spider portion, the frustroconical subcone portion, and the annular portion are formed together as a single piece and are not made integral by connecting any two of the spider portion, the frustroconical subcone portion, and the annular portion; 4) a surround oriented coaxially with the magnet assembly and having a front edge defining a surround front edge plane, and a radially inner surround flange angled forward from a plane parallel to the diaphragm front surface at the first angle to be substantially parallel to the radially outer circumferential diaphragm flange; 5) a flat annular diaphragm oriented coaxially with the magnet assembly and having a diaphragm front surface and a diaphragm rear surface, the diaphragm supported by the surround and by the spidercone, in a quiescent state position, with the diaphragm front surface substantially coplanar with the surround front edge plane; and 6) a basket supporting the magnet assembly, the spidercone, and the surround, wherein the basket is sized, shaped, and arranged to couple to the spidercone and to support the spidercone, the basket having: an interior basket surface portion inclined to be parallel to the tangential radially outer circumferential attachment flange when the spidercone is coupled to the basket, the basket having at least one peripheral opening.

The invention may also provide that the flexible annular portion of the frustroconical subcone portion of the spidercone comprises an inner circumferential spidercone flange angled rearward at a second angle and sized, shaped, and arranged to extend into the circumferential adhesive well during assembly of said shallow speaker.

BRIEF DESCRIPTION OF THE DRAWINGS

The above and other objects and advantages of the present invention will become more apparent from the following description taken in conjunction with the following drawings in which.

DETAILED DESCRIPTION OF THE BEST MODES AND PREFERRED EMBODIMENTS OF THE INVENTION

As used and defined herein, "front" means proximal to the primary sound-emitting end of the speaker and "rear" means distal the primary sound-emitting end of the speaker. As used and defined herein, "integral", when applied to a structure, means a structure made as a single entire piece in one operation, optionally with portions later given various treatments and modifications, but not a structure assembled from separate parts.

Figure 1:
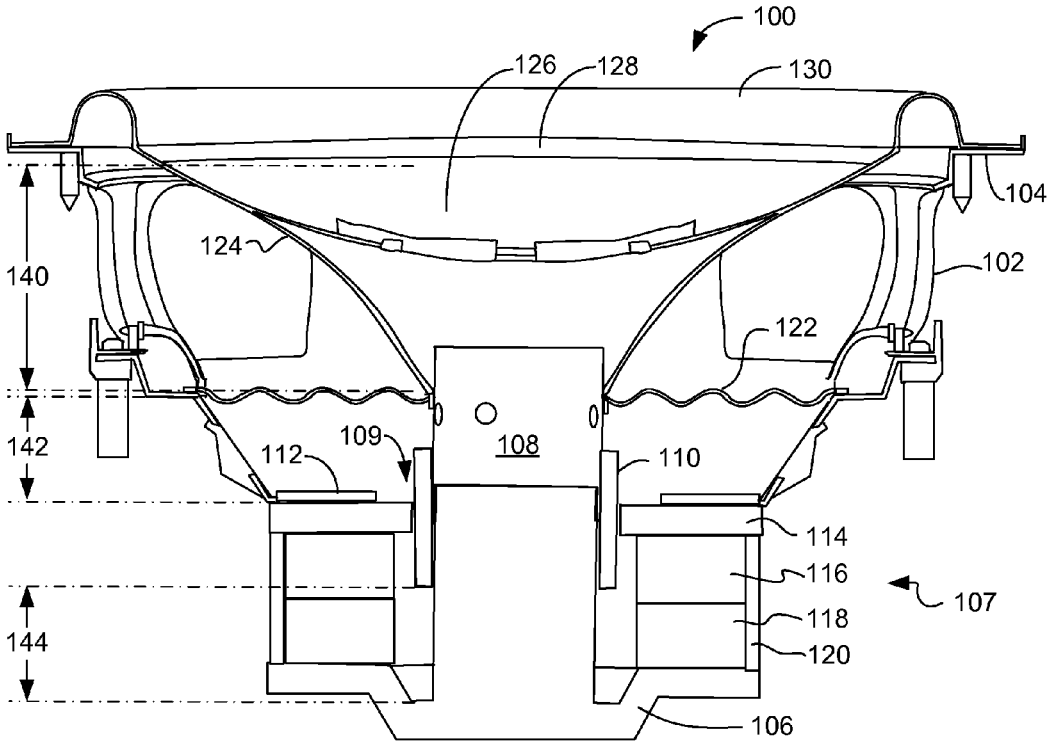
FIG. 1 PRIOR ART
FIG. 1 shows a side elevation cross-sectional view illustrating a prior art embodiment of a speaker.

FIG. 1 shows a side elevation cross-sectional view illustrating a prior art embodiment of a speaker 100. The speaker 100 is structured and supported by the basket 102 that has a surround plateau 104 for supporting surround 130. The basket 102 supports magnet assembly 107, which includes pole piece 106, casing 120, magnetically permeable layer 118, magnet 116, magnetically permeable head plate 114, and top piece 112. Magnetically permeable head plate 114 is sized and shaped relative to pole piece 106 to create annular air gap 109. Voice coil 110, wound on former 108, is free to move axially in air gap 109. Former 108 is coupled to subcone 124, which has a minimum radius as the former 108 radius. Former 108 is also coupled to spider 122, which flexibly supports former 108, voice coil 110, and subcone 124. Subcone 124 is coupled to and supports diaphragm 126, which is also attached to flange 128 of surround 130 and is flexibly supported by surround 130.

The depth of speaker 100 is dependent on three parameters. The first parameter is surround limit 140 on the motion of the diaphragm 126 as apparently constrained by the basket 102 and actually constrained by the surround 130. Normally, the basket 102 is designed to allow full use of the flexibility of the surround 130, so the basket 102 constraint is a secondary indicator of the flexibility of the surround 130. Spider range 142 is the range of motion over which the spider 122 does not get ingested into the air gap 109 during downward motion of the former 108. Because the spider 122 is attached directly to the former 108, there is also potential for interference between the magnetically permeable head plate 114. Spider range 142 is a significant contributor to the depth of speaker 100. Excursion depth 144 defines the maximum downward excursion of the voice coil 110 and former 108. The excursion range of the former 108 and voice coil 110 is a factor in the volume displacement, sensed as loudness, of the speaker 100. The larger the excursion depth 144 for a given diaphragm, the greater the volume displacement becomes, creating a louder speaker 100.

Figure 2:
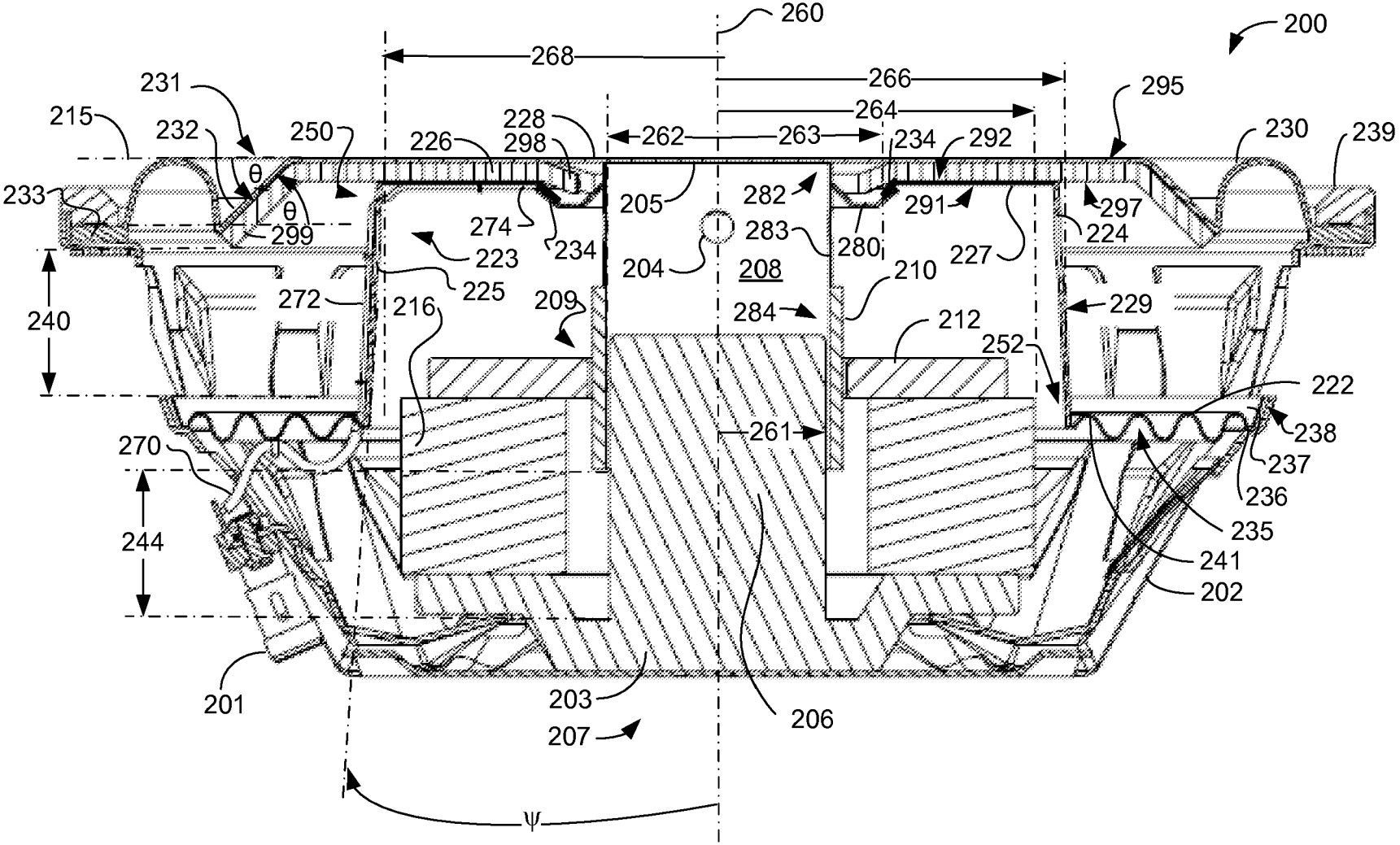
FIG. 2 shows a side elevation cross-sectional view illustrating an exemplary novel shallow speaker, according to a preferred embodiment of the present invention.

FIG. 2 shows a side elevation cross-sectional view illustrating an exemplary novel shallow speaker 200, according to a preferred embodiment of the present invention. Longitudinal axis 260 is preferably an axis of radial symmetry for the shallow speaker 200 and magnet assembly 207 and is the reference from which all radii discussed below are measured. Basket 202 provides structural support for the magnet assembly 207, the spider portion 222 of spidercone 224, and the narrow surround 230. A "spidercone" 224 as used and defined herein, means an integrally formed spider portion 222 and frustroconical subcone portion 223, in which the frustroconical subcone portion 223 has a maximum (rear-end) radius 266 greater than the maximum radius 264 of the magnet assembly 207 and a spidercone minimum (front-end) radius 263 smaller than the maximum radius 264 of the magnet assembly 207. Magnet assembly 207 includes pole piece 206, which includes bottom portion 203. The bottom portion 203 of pole piece 206 supports magnet 216. Magnet 216 is preferably a neodymium magnet. Magnet 216 supports top piece 212. Pole piece 206 forms an annular air gap 209 with top piece 212, and magnet 216. Magnet assembly 207 is preferably radially symmetrical about longitudinal axis 260 and has a magnet assembly maximum radius 264.

Voice coil 210 is wound on former 208 and both are sized, shaped, and arranged to enable movement of the voice coil 210 axially within the annular air gap 209. Former 208 is preferably a right circular cylindrical web 283 with an end cap 205 and vents 204. Former 208 has a front end 282 and a rear portion 284. A circumferential adhesive well 280 extends radially outward from former 208 proximate the front end 282 of former 208. The former 208 has a former inner radius 262 greater than the pole piece radius 261 of pole piece 206 and less than the spidercone minimum radius 263. Front end 282 is preferably proximate diaphragm 226.

Spidercone 224 is formed as a single integral piece. Spidercone 224 is preferably made of a die-pressed layered composite of cotton-nomex fabric, resin, and hardening adhesive. Spidercone 224 is preferably coaxially aligned with magnet 216, former 208, surround 230, and magnet assembly 207. Spidercone 224 includes a frustroconical subcone portion 223 and an integral spider portion 222. The frustroconical subcone portion 223 and the spider portion 222 are formed integrally and are not formed as separate pieces that are later connected.

The frustroconical subcone portion 223 includes a right frustroconical web 225 integral with a flexible annular portion 227. The right frustroconical web 225 has a narrower front circular end 250 defined by front-end radius 268 and a wider rear (second) circular end 252 defined by rear-end radius 266. Rear-end radius 266 of the right frustroconical web 225 is greater than front-end radius 268 of the right frustroconical web 225. Rear-end radius 266 of the right frustroconical web 225 is also greater than magnet assembly maximum radius 264, enabling the right frustroconical web 225 to move axially without interference from magnet assembly 207. The right frustroconical web 225 has a radially outer surface 229.

The front circular end 250 and the rear circular end 252 define a half-cone angle $\psi$ of at least three degrees. The right frustroconical web 225 includes a plurality of openings 302 and 306 (See FIG. 8) for ventilation and for other purposes discussed in more detail below. Openings 302 and cone tinsel opening 306 are preferably formed by cutting or punching the spidercone 224 after it has cured. Those of skill in the art of die-pressed fabric-resin composites, enlightened by this disclosure, will appreciate the various approaches that can be taken to provide openings 302 and cone tinsel opening 306 in the die.

The flexible annular portion 227 is integral to the front circular end 250 of the right frustroconical web 225 and is interior to the front circular end 250 of the right frustroconical web 225. Annular portion 227 is preferably primarily coplanar with front circular end 250. Annular portion 227 has a front annular surface 292 and a rear annular surface 291. The flexible annular portion 227 partially closes the front circular end 250 of the right frustroconical web 225. The inner annular radius 263 of the flexible annular portion 227 is the minimum radius 263 of the frustroconical subcone portion 223 and is also the spidercone minimum radius 263 of the spidercone 224. Spidercone minimum radius 263 is smaller than the magnet assembly maximum radius 264. In a preferred embodiment, flexible annular portion 227 has a radially inner circumferential spidercone flange 234 that is angled rearward at a second angle and sized, shaped, and arranged to extend into radially outer circumferential adhesive well 280, as is shown in more detail in FIG. 3 and further discussed below. Accordingly, the term "frustroconical subcone portion", as used and defined herein, means a right frustroconical web 223 having at least one opening 302 or cone tinsel opening 306, a front circular end 250 having a smaller radius than the rear circular end 252, the right frustroconical web 225 extending radially inwardly, forwardly, rigidly, and integrally from flexible innermost roll 241 of spider portion 222 to the front circular end 250 with a half-cone angle $\psi$ of at least three degrees and a flexible annular portion 227 extending radially inwardly and integrally from, and interior to, the front circular end 250 to a spidercone minimum radius 263 that is smaller than the magnet assembly maximum radius 264.

Spider portion 222 flexibly supports the frustroconical subcone portion 223 and is formed integrally to the frustroconical subcone portion 223. The spider portion 222, the right frustroconical web 225, and the flexible annular portion 227 are not made integral by connecting any two of the portions 222, 225, and 227. Rather, the spider portion 222, the right frustroconical web 225, and the flexible annular portion 227 are made integral by being formed as a single die-pressed composite piece.

Spider portion 222 includes radially undulate circumferential corrugations, or rolls, 235, which provide for expansion and contraction of the spider portion 222 as the spidercone 224 moves. The outermost roll 236 of rolls 235 terminates integrally in a tangential radially outer circumferential attachment flange 237, which includes a flat portion of the spider portion 222 extending from outermost roll 236 along a line, as seen in cross-section, that is tangent to the curvature of the outermost roll 236. The advantage of the integral tangential radially outer circumferential attachment 237 is that it allows an increased number of rolls 235 in the space available, even if fractionally so, than traditional radially-extending flanges. Additional rolls 235, in turn, provide increased expansion and contraction. During assembly of the shallow speaker 200, the tangential radially outer circumferential attachment flange 237 is coupled to an interior basket surface portion 238 of basket 202 that is inclined to be parallel to the tangential radially outer circumferential attachment flange 237 of the spidercone 224 when the shallow speaker 200 is in a quiescent state. The connection of the tangential radially outer circumferential attachment flange 237 and the interior basket surface portion 238 of basket 202 is shown in more detail in FIG. 6 and further discussed below. The definition of "spider portion" 222, as used and defined herein, is: a portion of a spidercone 224 operable to serve a spider function, having a plurality of rolls 235 operable to be coupled to speaker basket 202 by a tangential radially outer circumferential attachment flange 237, extending inwardly and integrally into the right frustroconical web 225 of frustroconical subcone portion 223 from the innermost roll 241.

The spidercone 224 supports a tinsel 270, which includes the wires which conduct the audio signal to the voice coil 210. Tinsel 270 is interwoven through the spider cone 224. The tinsel 270 extends from the audio coupling 201 of the shallow speaker 200 and is attached to the underside of spider portion 222. The spider portion 222 preferably includes a spider tinsel opening 304 (See FIG. 8) for extending the tinsel 270 through the spider portion 222 and over a portion of the radially outer surface 229 of the right frustroconical web 225, as shown. First tinsel portion 272 of tinsel 270 is affixed to a portion of the radially outer surface 229 of the right frustroconical web 225, preferably by a combination of staples or ties, and adhesives. First tinsel portion 272 of tinsel 270 extends to a point proximate the front circular end 250 of the right frustroconical web 225, as shown. Tinsel 270 extends through a cone tinsel opening 306 in the right frustroconical web 225 that opens proximate the rear annular surface 291 of flexible annular portion 227. Second tinsel portion 274 of tinsel 270 is affixed to the rear annular surface 291 of flexible annular portion 227 by a combination of staples or ties, and adhesives. Tinsel 270 extends further to be physically coupled, during assembly, to the former 208 proximate the front end 282 of former 208 and then to the voice coil 210. The routing of the tinsel 270 is shown in more detail in FIG. 4 and is further discussed below.

Spidercone 224 is also coupled to flat annular diaphragm 226 and conducts the motive force of the former 208 to the flat annular diaphragm 226 via the circumferential adhesive well 280. A portion of front annular surface 292 of flexible annular portion 227 of spidercone 224 is preferably adhesively coupled to a portion of the diaphragm rear surface 297 of diaphragm 226 and so supports, pushes, and pulls diaphragm 226. Diaphragm 226 is preferably annular and substantially flat, as shown. Diaphragm 226 has an integral and radially outer circumferential diaphragm flange 299 that is angled rearward by a first angle 0, which is preferably 45 degrees. In various alternate embodiments, angles 0 between 30 and 60 degrees may be used. Diaphragm 226 has an integral and radially inner circumferential diaphragm flange 298 that is angled rearward from the diaphragm front surface 295 at a second angle of about 30 degrees, as shown in more detail in FIG. 3 and discussed below. In various alternate embodiments, other angles between 20 and 40 degrees may be used. Diaphragm 226 has a diaphragm front surface 295 and a diaphragm rear surface 297. Diaphragm 226 is preferably substantially rigid.

Diaphragm 226 is flexibly supported by surround 230, which is coupled to the outer circumferential diaphragm flange 299 of the diaphragm 226 and to the basket 202. Surround 230 has an integral surround gasket 233 for assisting in coupling to basket 202. Surround 230 is preferably more narrow than a semi-circular surround, to allow for more diaphragm 226 area and, therefore, greater volume displacement.

Surround 230 has a front edge 231 that defines a surround front edge plane 215. The diaphragm front surface 295 of diaphragm 226 is preferably coplanar with the surround front edge plane 215 defined by front edge 231 of surround 230 when the shallow speaker 200 is in a quiescent state. This design feature assists in further reducing the depth of shallow speaker 200.

Surround 230 has a radially inner surround flange 232 angled forward from a plane parallel to the top surface of diaphragm 226 by a first angle 0, which is preferably 45 degrees, but which, in any alternate embodiment, is the same angle 0 as the rearward angle 0 of the outer circumferential diaphragm flange 299 of diaphragm 226. Accordingly, the radially inner surround flange 232 and the outer circumferential diaphragm flange 299 of diaphragm 226 will be parallel in all embodiments. The advantage of the forward angle of the radially inner surround flange 232 is that the radially inner surround flange 232 takes up less frontal speaker area and so allows a larger diaphragm 226 and a greater volume displacement. Radially inner surround flange 232 and outer circumferential diaphragm flange 299 of diaphragm 226 are preferably adhesively coupled. The connection between surround 230 and diaphragm 226 is shown in more detail in FIG. 8 and is further discussed below.

Dust cap 228 has a top surface 271. Dust cap overlays the diaphragm 226, including the central annular opening of diaphragm 226. The outer edges of dust cap 228 are preferably flush with the edge of the radially inner surround flange 232, when coupled to the diaphragm 226. Dust cap 228 is preferably thin and lightweight, and top surface 271 may be decorated.

The excursion depth 244 for shallow speaker 200 is the same as excursion depth 144 for speaker 100. Due to the novel design, no corollary to spider range 142 is found in shallow speaker 200. As a result, significant depth reduction is realized in the design of shallow speaker 200. Surround limit 240 is reduced, relative to surround limit 140 in speaker 100, due to the design of the diaphragm 226. The surround limit 240 may be reduced to equal the excursion depth 144, as shown. The range of motion of the diaphragm 226, as limited by the surround 230, is the same range of motion as the excursion depth 244, as the voice coil 210 drives both limits.

By eliminating the spider range 142, reducing the surround limit 240, and employing a flat diaphragm 226 positioned level with the front edge 231 of surround 230, significant reduction in speaker depth has been achieved. The spider range was eliminated with a novel spidercone 224 that extends substantially outside of the magnetic assembly 207, resulting in a spider portion 222 that is not directly connected to the former 208.

Figure 3:
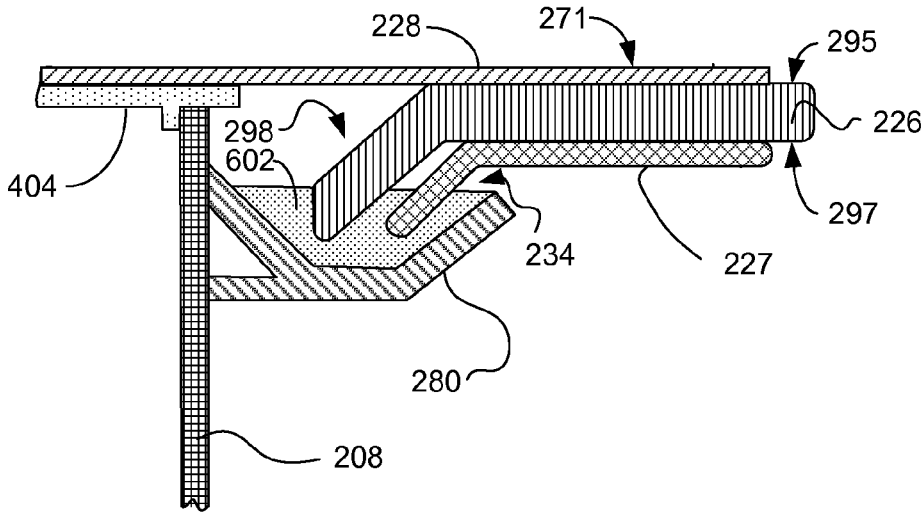
FIG. 3 is a cross-sectional cut-away elevation detail, in a single plane, of an exemplary circumferential adhesive well, exemplary inner circumferential diaphragm flange, and exemplary radially inner circumferential spidercone flange, according to a preferred embodiment of the present invention as shown in FIG. 2.

FIG. 3 is a cross-sectional cut-away elevation detail, in a single plane, of an exemplary circumferential adhesive well 280, exemplary inner circumferential diaphragm flange 298, and exemplary radially inner circumferential spidercone flange 234, according to a preferred embodiment of the present invention as shown in FIG. 2. Preferably, radially inner circumferential spidercone flange 234 is angled rearward from annular portion 227 of spidercone 224 and extends into epoxy adhesive 602 filling circumferential adhesive well 280. Clearly, the shallow speaker 200 is built with the front facing upward, to allow the circumferential adhesive well 280 to contain the epoxy in uncured, liquid form. Inner circumferential diaphragm flange 298 of flat annular diaphragm 226 is preferably suspended in epoxy adhesive 602 filling circumferential adhesive well 280. Circumferential adhesive well 280 is affixed or integral to former 208. Force exerted by the former 208 is transferred to the circumferential adhesive well, then to the epoxy 602, then to flexible annular portion 227 and diaphragm 226. Dust cap 228 adheres to diaphragm outer surface 295. Paper support 404 is affixed to former 208 and contacts dust cap 228. In an alternate embodiment, paper support 404 may extend outwardly to engage integral and radially inner circumferential diaphragm flange 298.

The advantage of circumferential adhesive well 280 is in centering the former 208, the diaphragm 226, and the spidercone 224 during assembly of the shallow speaker 200. A fixture is used to critically align former 208 to annular air gap 209. The spidercone 224 may then be installed. Inner circumferential diaphragm flange 298 is suspended in circumferential adhesive well 280. Next, the diaphragm 226 may be aligned and installed, and circumferential adhesive well 280 filled with epoxy 602. Once the epoxy 602 hardens, the alignments remain intact.

In an alternate embodiment, the circumferential adhesive well 280 may be partitioned to have separate adhesive chambers for the radially inner circumferential spidercone flange 234 and the inner circumferential diaphragm flange 298. In another alternate embodiment, the radially inner circumferential spidercone flange 234 may be omitted (see FIG. 9, 14, 15).

Figure 4:
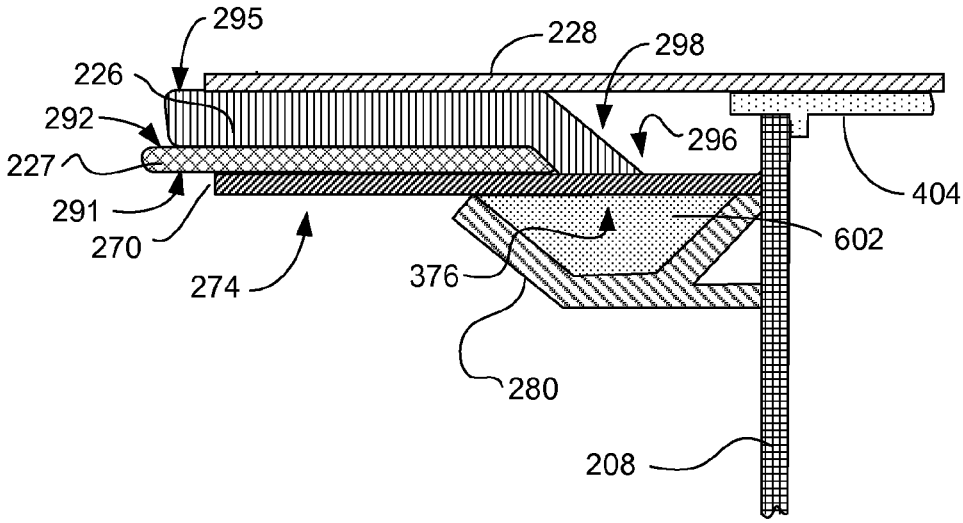
FIG. 4 is a cross-sectional cut-away elevation detail, in a single plane, of an exemplary circumferential adhesive well, exemplary inner circumferential diaphragm flange, exemplary tinsel, and exemplary radially inner circumferential spidercone flange, according to a preferred embodiment of the present invention as shown in FIG. 2.

FIG. 4 is a cross-sectional cut-away elevation detail, in a single plane, of an exemplary circumferential adhesive well 280, exemplary inner circumferential diaphragm flange 298, exemplary tinsel 270, and exemplary radially inner circumferential spidercone flange 234, according to a preferred embodiment of the present invention as shown in FIG. 2. The section is through flange notch 296 in inner circumferential diaphragm flange 298 and radially inner circumferential spidercone flange 234. Flange notch 296 is further illustrated in FIG. 9 and discussed below. The relationships of the diaphragm 226, flexible annular portion 227, paper support 404, former 208, and circumferential adhesive well 280 are the same as described under FIG. 3, above. Second tinsel portion 274 of tinsel 270 is affixed to flexible annular portion 227. Third tinsel portion 376 of tinsel 270 is affixed the former 208, as shown, to electrically connect with the voice coil 210 (not shown in this view).

Figure 5:
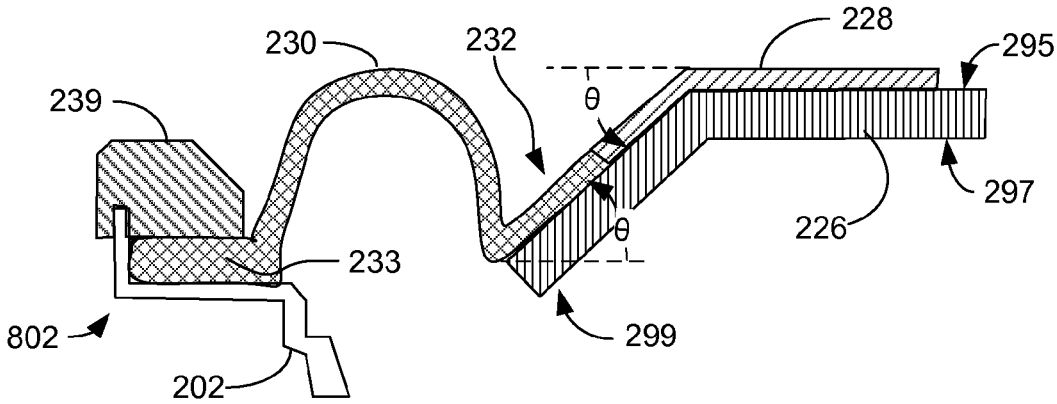
FIG. 5 is a cross-sectional cut-away elevation detail, in a single plane, of an exemplary connection between an exemplary surround and an exemplary diaphragm, according to a preferred embodiment of the present invention as shown in FIG. 2.

FIG. 5 is a cross-sectional cut-away elevation detail, in a single plane, of an exemplary connection between an exemplary surround 230 and an exemplary diaphragm 226, according to a preferred embodiment of the present invention as shown in FIG. 2. Surround 230 includes an integral surround gasket 233 and radially inner surround flange 232. Radially inner surround flange 232 is angled to be parallel to outer circumferential diaphragm flange 299. Radially inner surround flange 232 and outer circumferential diaphragm flange 299 are made of materials operable to be adhesively affixed to one another. Rim clamp 239 secures integral surround gasket 233 to basket rim 802 of basket 202. Radially inner surround flange 232 may have the same thickness as dust cap 228, creating a flush joint between the two. In an alternate embodiment, the radially inner surround flange 232 and the dust cap 228 do not join.

Figure 6:
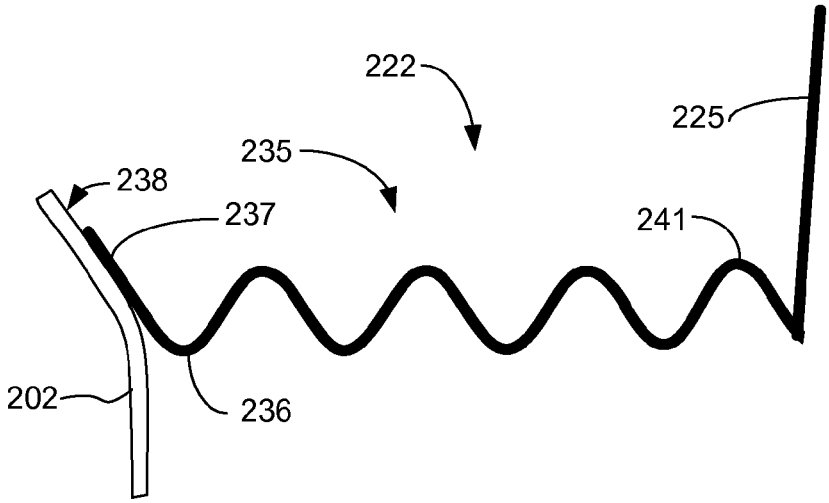
FIG. 6 is a cross-sectional cut-away elevation detail, in a single plane, of an exemplary connection between an exemplary basket and an exemplary spider portion, according to a preferred embodiment of the present invention as shown in FIG. 2.

FIG. 6 is a cross-sectional cut-away elevation detail, in a single plane, of an exemplary connection between an exemplary basket 202 and an exemplary spider portion 222, according to a preferred embodiment of the present invention as shown in FIG. 2. Basket 202 has an inclined interior basket surface portion 238. Spider portion 222 has rolls 235. Outermost roll 236 has an integral tangential radially outer circumferential attachment flange 237 that is parallel to and affixed to inclined interior basket surface portion 238. Spider portion 222 is formed integral with right frustroconical web 225 at a non-tangential (acute) angle with the innermost roll 241.

Figure 7:
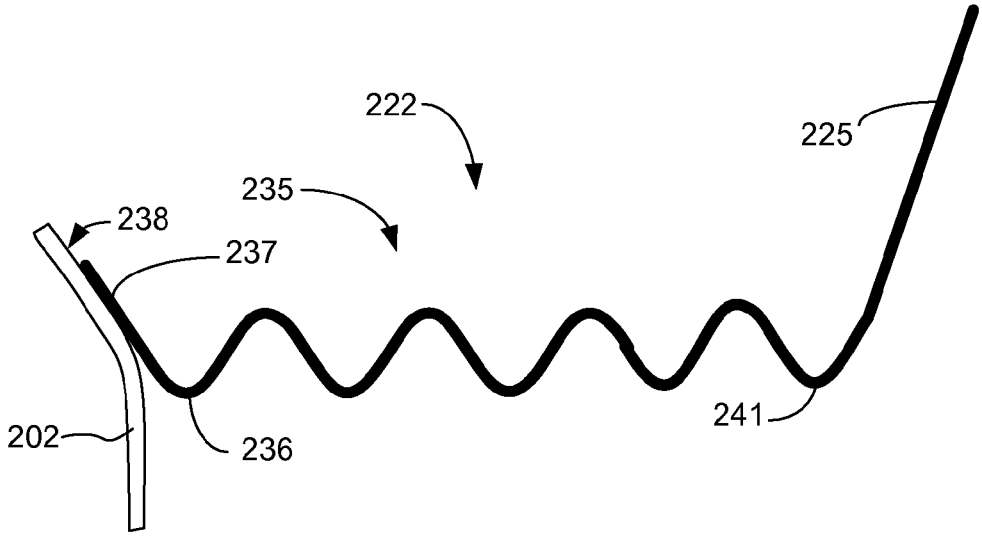
FIG. 7 is a cross-sectional cut-away elevation detail, in a single plane, of an alternate exemplary connection between an exemplary basket and an exemplary spider portion, according to a preferred embodiment of the present invention.

FIG. 7 is a cross-sectional cut-away elevation detail, in a single plane, of an alternate exemplary connection between an exemplary spider portion 222 and an exemplary right frustroconical web 225, according to a preferred embodiment of the present invention. The alternate embodiment of FIG. 7 is similar to the embodiment of FIG. 6, except that spider portion 222 is formed integrally with right frustroconical web 225 terminating at an approximately tangential angle with the innermost roll 241.

Figure 8:
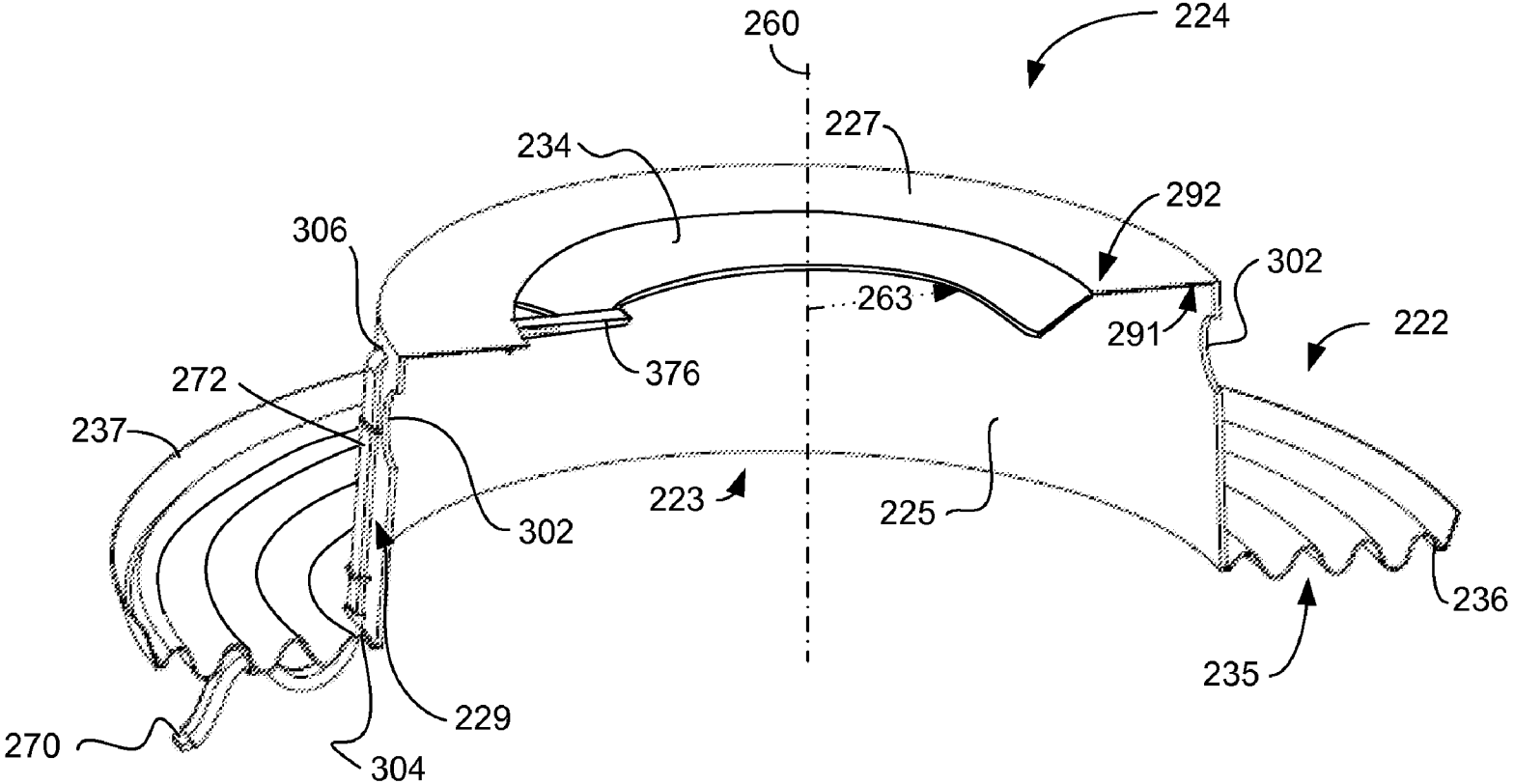
FIG. 8 is a perspective bisectional view illustrating an exemplary embodiment of spidercone for an exemplary novel shallow speaker, according to a preferred embodiment of the present invention.

FIG. 8 is a perspective bisectional view illustrating an exemplary spidercone 224 for an exemplary novel shallow speaker 200, according to a preferred embodiment of the present invention as shown in FIG. 2. Here, radially inner circumferential spidercone flange 234 defines spidercone minimum radius 263. Openings 302 in right frustroconical web 225 are to relieve back pressure between the spidercone 224 and the magnet assembly 207 and basket 202. In a particular embodiment, basket 202 has peripheral basket openings 402 and openings 302 may be aligned with peripheral basket openings 402 to reduce flow resistance through opening 302.

Spider tinsel opening 304 is through the spider portion 222 of the spidercone 224. Tinsel 270 is threaded through spider tinsel opening 304, which is preferably no larger than necessary to receive the tinsel 270. Spider tinsel opening 304 preferably has rounded corners. First tinsel portion 272 of tinsel 270 is affixed to radially outer surface 229 of right frustroconical web 225. Tinsel 270 is threaded through cone tinsel opening 306, which is preferably no larger than necessary to receive the tinsel 270. Cone tinsel opening 306 preferably has rounded corners. Cone tinsel opening 306 is preferably located just below the rear annular surface 291of the flexible annular portion 227 of the frustroconical subcone portion 223. As shown in FIG. 2, a second tinsel portion 274 of tinsel 270 is affixed to the rear annular surface 291 of the flexible annular portion 227 of the frustroconical subcone portion 223. Third tinsel portion 376 of tinsel 270 extends interior to the flexible annular portion 227 for attachment, during assembly of the speaker, to the former 208 and voice coil 210 (see FIG. 2).

It should be appreciated that spider tinsel opening 304 and cone tinsel opening 306 are preferably aligned and arranged relative to openings 302 so as to prevent threading first tinsel portion 272 of tinsel 270 over an opening 302. The location of spider tinsel opening 304 and cone tinsel 306 compel a preferred rotational orientation of the spidercone 224 relative to the basket 202, as the tinsel 270 preferably aligns with the audio coupling 201. Likewise, the third tinsel portion 376 preferably aligns with the voice coil 210 connectors (not shown). Within those constraints, various tinsel 270 threading schemes may be used with various alternate embodiments of the present invention.

Figure 9:
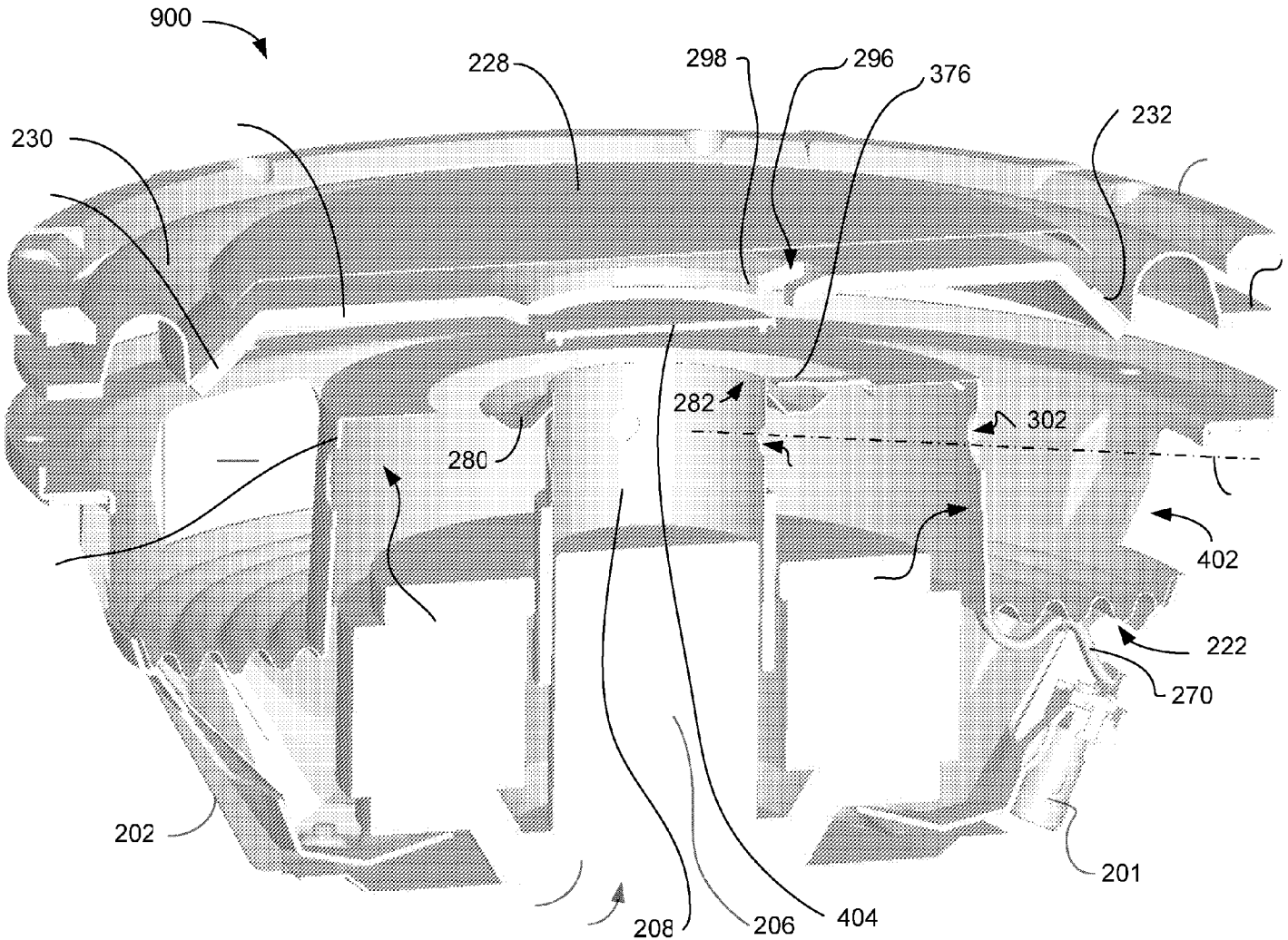
FIG. 9 is rendered perspective bisectional exploded view illustrating another exemplary embodiment of an exemplary novel shallow speaker, according to a preferred embodiment of the present invention.

FIG. 9 is a rendered perspective bisectional exploded view illustrating another exemplary embodiment of a novel shallow speaker 900, according to an alternate preferred embodiment of the present invention. Basket 202 of speaker 900 has peripheral openings 402. Preferably, the vents 204 of former 208, the openings 302 of spidercone 924, and the peripheral basket openings 402 of the basket 202 are aligned, as along axis 406, in the quiescent state. While the spidercone 924 and former 208 move axially (relative to longitudinal axis 260) in operation, the alignment is still worthwhile for reducing resistance to air flow through vents 204, openings 302, and peripheral basket openings 402. Shallow speaker 900 includes paper support 404 that attaches to the front end 282 of former 208 and supports dust cap 228 to prevent snapping.

In the embodiment of FIG. 9, radially inner circumferential spidercone flange 234 of flexible annular portion 227 of spidercone 224 is absent. Notch 296 is sized, shaped, and arranged to allow third tinsel portion 376 of tinsel 270 to be threaded through notch 296.

Figure 10:
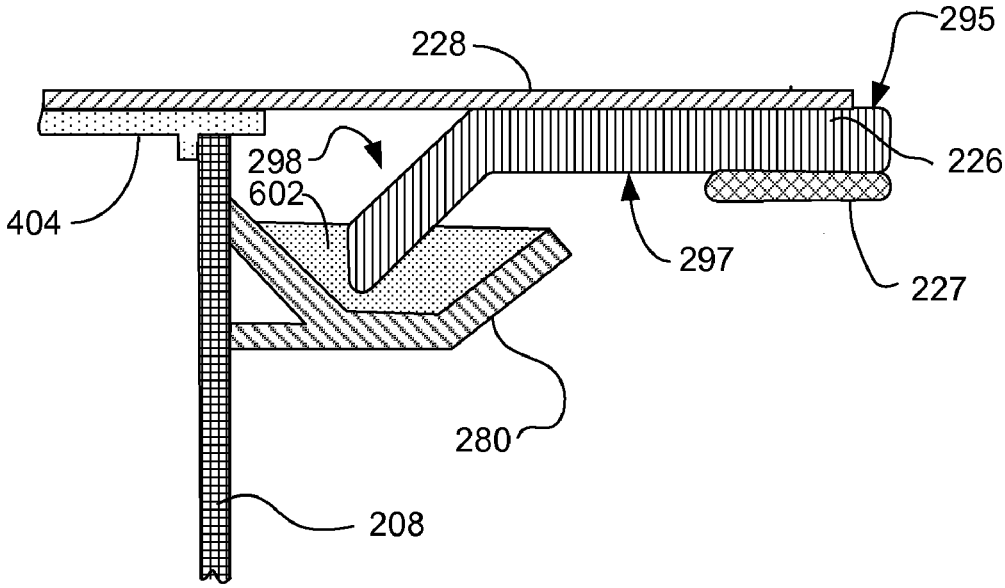
FIG. 10 is a cross-sectional cut-away elevation detail, in a single plane, of an exemplary circumferential adhesive well, exemplary inner circumferential diaphragm flange, and absent radially inner circumferential spidercone flange, according to a preferred embodiment of the present invention as shown in FIG. 9.

FIG. 10 is a cross-sectional cut-away elevation detail, in a single plane, of an exemplary circumferential adhesive well 280, exemplary inner circumferential diaphragm flange 298, and absent radially inner circumferential spidercone flange 234, according to a preferred embodiment of the present invention as shown in FIG. 9. Radially inner circumferential spidercone flange 234 of flexible annular portion 227 of spidercone 224 is absent. Inner circumferential diaphragm flange 298 of flat annular diaphragm 226 is preferably suspended in circumferential adhesive well 280, which is affixed or integral to former 208. Force exerted by the former 208 is transferred to the circumferential adhesive well, then to the epoxy 602, then to inner circumferential diaphragm flange 298, then to diaphragm 226. Dust cap 228 adheres to diaphragm 226. Paper support 404 is affixed to former 208 and contacts dust cap 228. In an alternate embodiment, paper support 404 may extend outwardly to engage integral and radially inner circumferential diaphragm flange 298.

Figure 11:
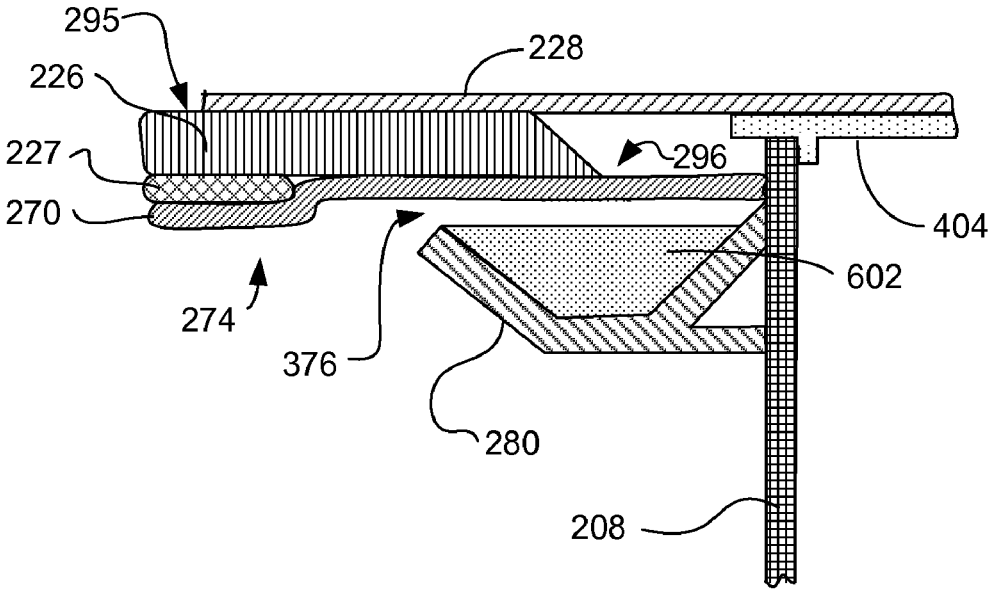
FIG. 11 is a cross-sectional cut-away elevation detail, in a single plane, of an exemplary circumferential adhesive well, exemplary inner circumferential diaphragm flange, exemplary tinsel, and absent radially inner circumferential spidercone flange, according to a preferred embodiment of the present invention as shown in FIG. 9.

FIG. 11 is a cross-sectional cut-away elevation detail, in a single plane, of an exemplary circumferential adhesive well 280, exemplary inner circumferential diaphragm flange 298, exemplary tinsel 270, and absent radially inner circumferential spidercone flange 234, according to a preferred embodiment of the present invention as shown in FIG. 9. The relationships of the diaphragm 226, flexible annular portion 227, paper support 404, former 208, and radially outer circumferential adhesive well 280 are the same as described under FIG. 10, above. Second tinsel portion 274 of tinsel 270 is affixed to flexible annular portion 227. Third tinsel portion 376 is affixed to former 208, as shown, to electrically connect with the voice coil 210 (not shown in this view).

Figure 12:
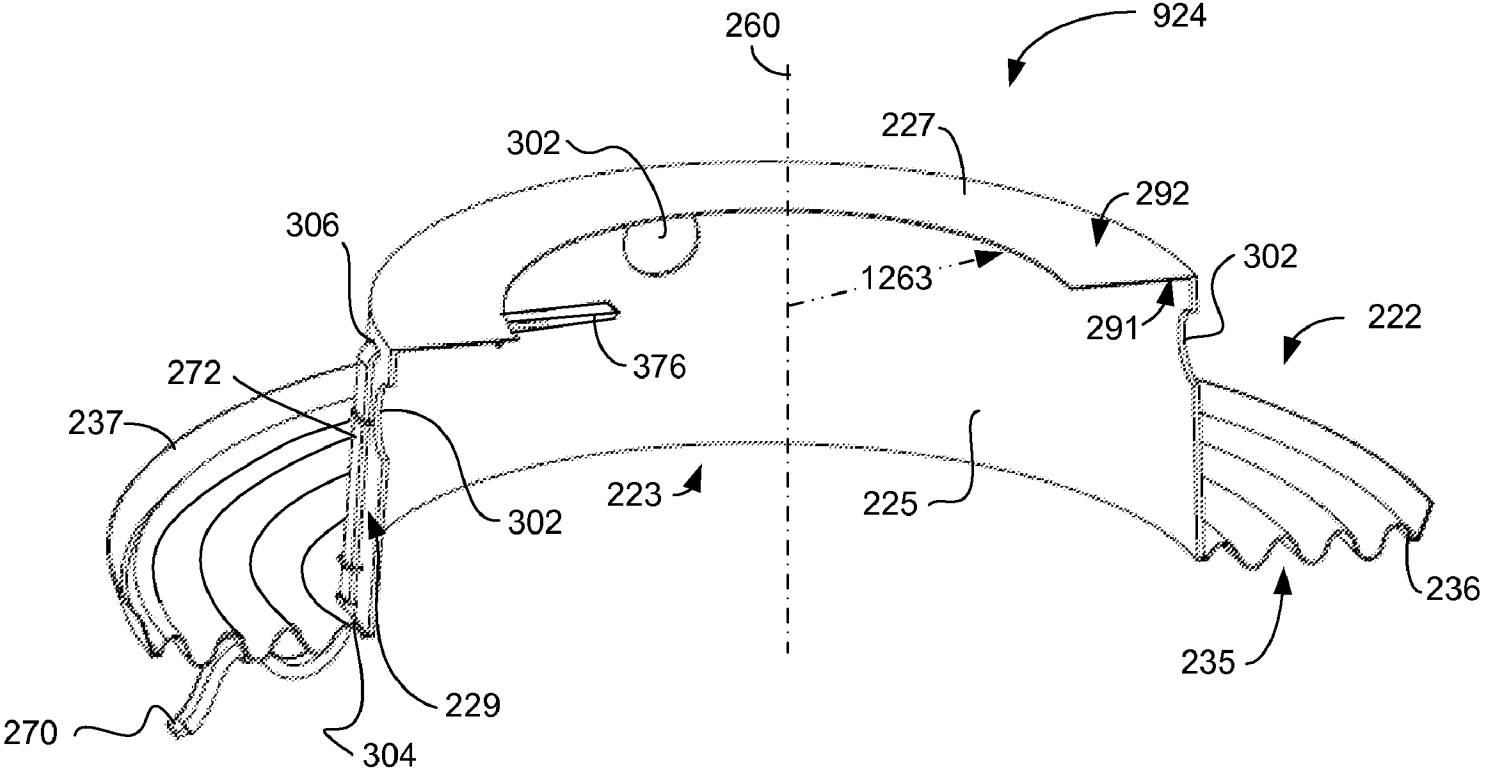
FIG. 12 is a perspective bisectional view illustrating an exemplary embodiment of spidercone for an exemplary novel shallow speaker, according to a preferred embodiment of the present invention as shown in FIG. 9.

FIG. 12 is a perspective bisectional view illustrating an exemplary spidercone 224 for an exemplary novel shallow speaker 900, according to a preferred embodiment of the present invention. Openings 302 in right frustroconical web 225 are to relieve back pressure between the spidercone 924 and the magnet assembly 207 and basket 202. In a particular embodiment, basket 202 has peripheral basket openings 402 (see FIG. 9) and openings 302 may be aligned with peripheral basket openings 402 to reduce flow resistance through opening 302. Radially inner circumferential spidercone flange 234 of flexible annular portion 227 of spidercone 224 is absent in spidercone 924. Flexible annular portion 227 has spidercone minimum radius 1263.

Spider tinsel opening 304 is through the spider portion 222 of the spidercone 924. Tinsel 270 extends through spider tinsel opening 304, which is preferably no larger than necessary to receive the tinsel 270. Spider tinsel opening 304 preferably has rounded corners. First tinsel portion 272 of tinsel 270 is affixed to radially outer surface 229 of right frustroconical web 225. Tinsel 270 is threaded through cone tinsel opening 306, which is preferably no larger than necessary to receive the tinsel 270. Cone tinsel opening 306 preferably has rounded corners. Cone tinsel opening 306 is preferably located just below the rear annular surface 291 of the flexible annular portion 227 of the frustroconical subcone portion 223. A second tinsel portion 274 of tinsel 270 is affixed to the rear annular surface 291 of the flexible annular portion 227 of the frustroconical subcone portion 223. Third tinsel portion 376 of tinsel 270 extends interior to the flexible annular portion 227 for attachment, during assembly of the speaker, to the former 208 and voice coil 210 (see FIG. 9).

It should be appreciated that spider tinsel opening 304 and cone tinsel opening 306 are preferably aligned and arranged relative to openings 302 so as to prevent threading first tinsel portion 272 of tinsel 270 over an opening 302. The location of spider tinsel opening 304 and cone tinsel opening 306 compel a preferred rotational orientation of the spidercone 924 relative to the basket 202, as the tinsel 270 preferably aligns with the audio coupling 201. Likewise, the third tinsel portion 376 preferably aligns with the voice coil 210 connectors (not shown). Within those constraints, various tinsel 270 threading schemes may be used with various alternate embodiments of the present invention.

Figure 13:
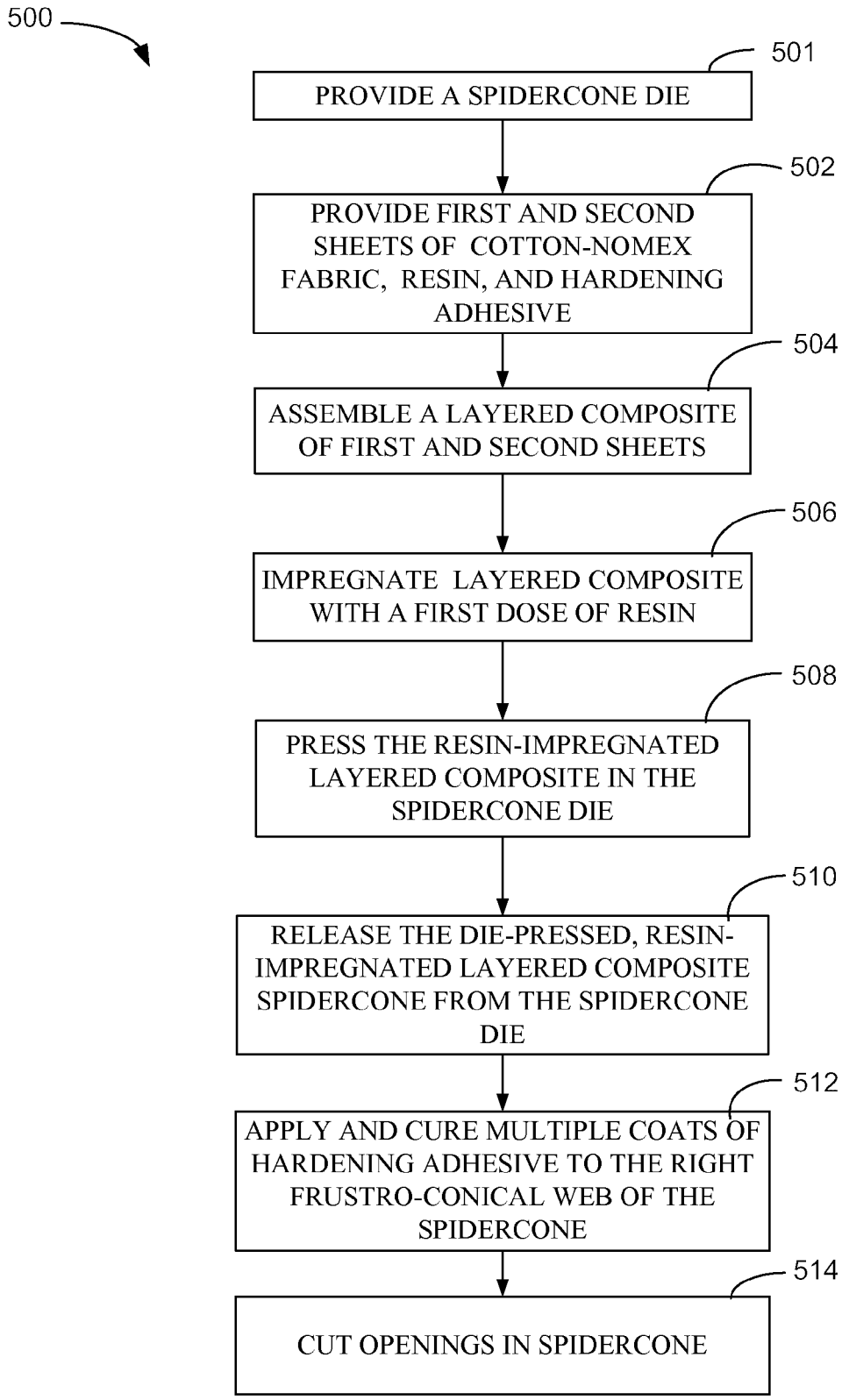
FIG. 13 is a process diagram illustrating the exemplary steps of an exemplary process of making the exemplary spidercone, according to a preferred embodiment of the present invention.

FIG. 13 is a process diagram illustrating the exemplary steps of an exemplary process 500 of making the exemplary spidercone 224, according to a preferred embodiment of the present invention. Spidercone 224 is preferably formed of die-pressed, resin-impregnated, cotton-nomex fabric. Process 500 begins with initial step 501 that includes providing a spidercone die. The spidercone die may be of any level of sophistication and complexity (or lack of same) but is preferably a two-piece, one-step spidercone die. In operation, the spidercone material to be shaped is placed in the spidercone die, the spidercone die is closed, and the spidercone material is shaped into a spidercone 224. Step 502 provides first and second sheets of cotton-nomex fabric, resin, and hardening adhesive. The hardening adhesive may be the hardening adhesive used to adhere voice coil 210 windings to former 208. The resin may be the same resin used to coat voice coil 210 windings. The first sheet is large enough to form the spidercone 224 and the second sheet is shaped to reinforce the right-frustroconical web 225. Provision of other materials and machines used in the die-press process 500 are also included in this step, though not called out by name. In assembly step 504, the first and second sheets of cotton-nomex fabric are layered and oriented such that the weave of the first cotton-nomex sheet (first weave) is at 45 degrees to the weave of the second cotton-nomex sheet (second weave). Weave angles other than 45 degrees may be used, but the first and second weaves should not be parallel. In first resin step 506, the arranged sheets of cotton-nomex fabric are impregnated with a resin. The resin is preferably thermally sensitive and cures rapidly when heat is applied. In pressing step 508, the resin-impregnated cotton-nomex fabric composite is pressed in the spidercone die provided in initial step 501 and may be heated. When the die-pressed resin-impregnated cotton-nomex fabric composite is released from the spidercone die in release step 510, the die-pressed resin-impregnated cotton-nomex fabric composite has the form of spidercone 224 and is resilient. Accordingly, the resulting spider portion 222 will have the desired ability to expand and contract. Some edge trimming may be required in release step 510. In rigidifying step 512, multiple coats (preferably six coats) of the hardening adhesive are applied to the right frustroconical web 225 and the hardening adhesive is allowed to cure. The additional coats of hardening adhesive make the right frustroconical web 225 substantially rigid, while the spider portion 222 and flexible annular portion 227 remain flexible and resilient. In cutting step 514, openings 302 are cut, punched, drilled, or otherwise created in the right frustroconical web 225, spider tinsel opening 304 is created in spider portion 222, and cone tinsel opening 306 is created in the right frustroconical web 225.

Figure 14:
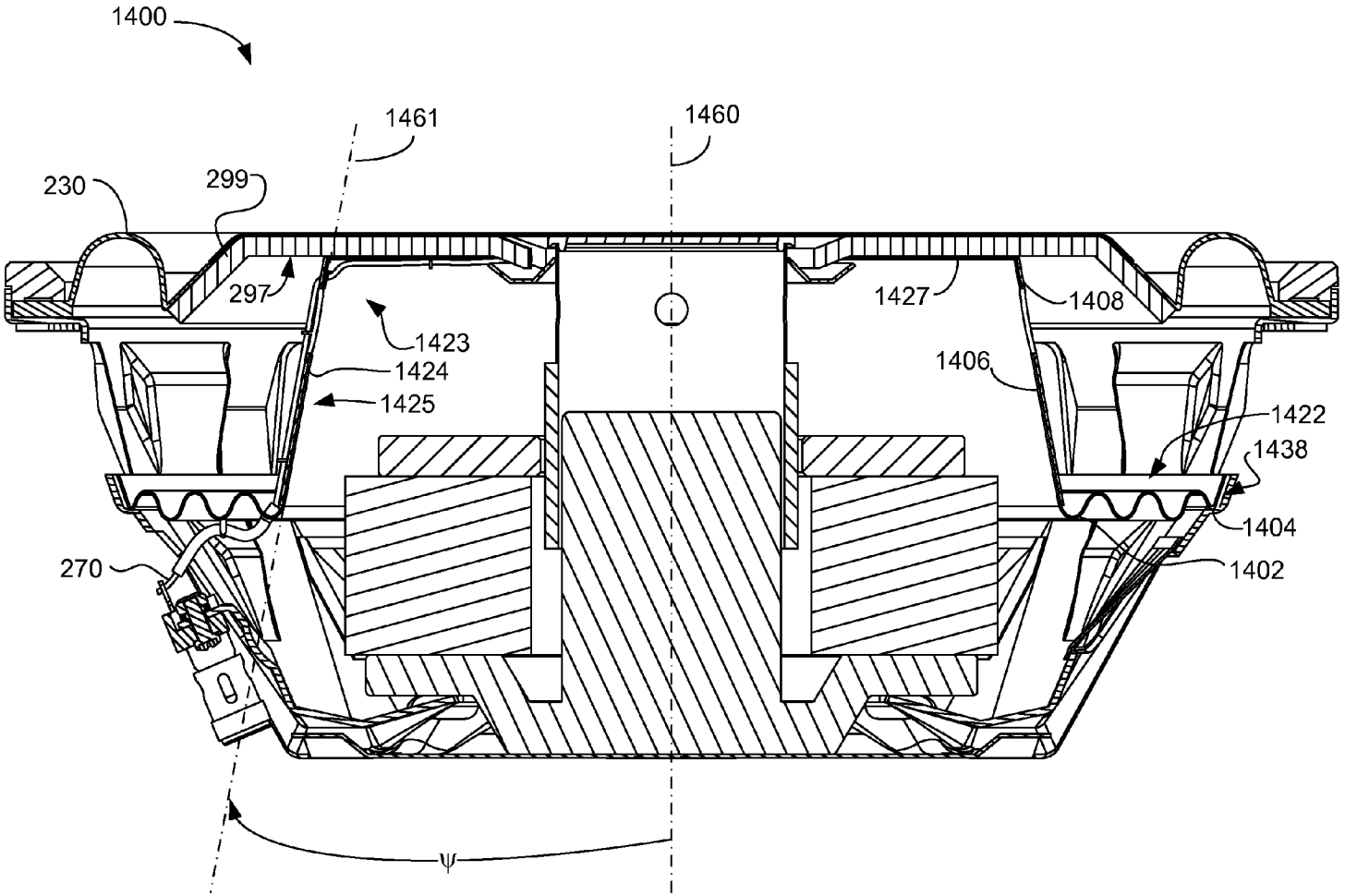
FIG. 14 is a bisectional elevation view of a third exemplary embodiment of a shallow speaker, according to a preferred embodiment of the present invention.

FIG. 14 is a bisectional elevation view of a third exemplary embodiment of a shallow speaker 1400, according to a preferred embodiment of the present invention. Shallow speaker 1400 differs from shallow speaker 200 in several ways. Shallow speaker 1400 illustrates a half-cone angle ψ of ten degrees, as compared to three degrees for shallow speaker 200. Half-cone angle ψ is measured from the longitudinal axis 1460 of radial symmetry to the slope 1461 of the right frustroconical web 1425 of frustroconical subcone portion 1423. Innermost roll 1402 terminates tangential to right frustro conical web 1425. Outermost roll 1404 is shown resting on a slight ledge in the inclined inner basket surface 1438. First sheet 1406 of cotton-nomex fabric forms the spider portion 1422, the inner wall of the right frustroconical web 1425, and the flexible annular portion 1427. Second sheet 1408 of cotton-nomex fabric forms the outer wall of the right frustroconical web 1425. Spider portion 1422 is formed integrally with frustroconical subcone portion 1423 of spidercone 1424.

Figure 15:
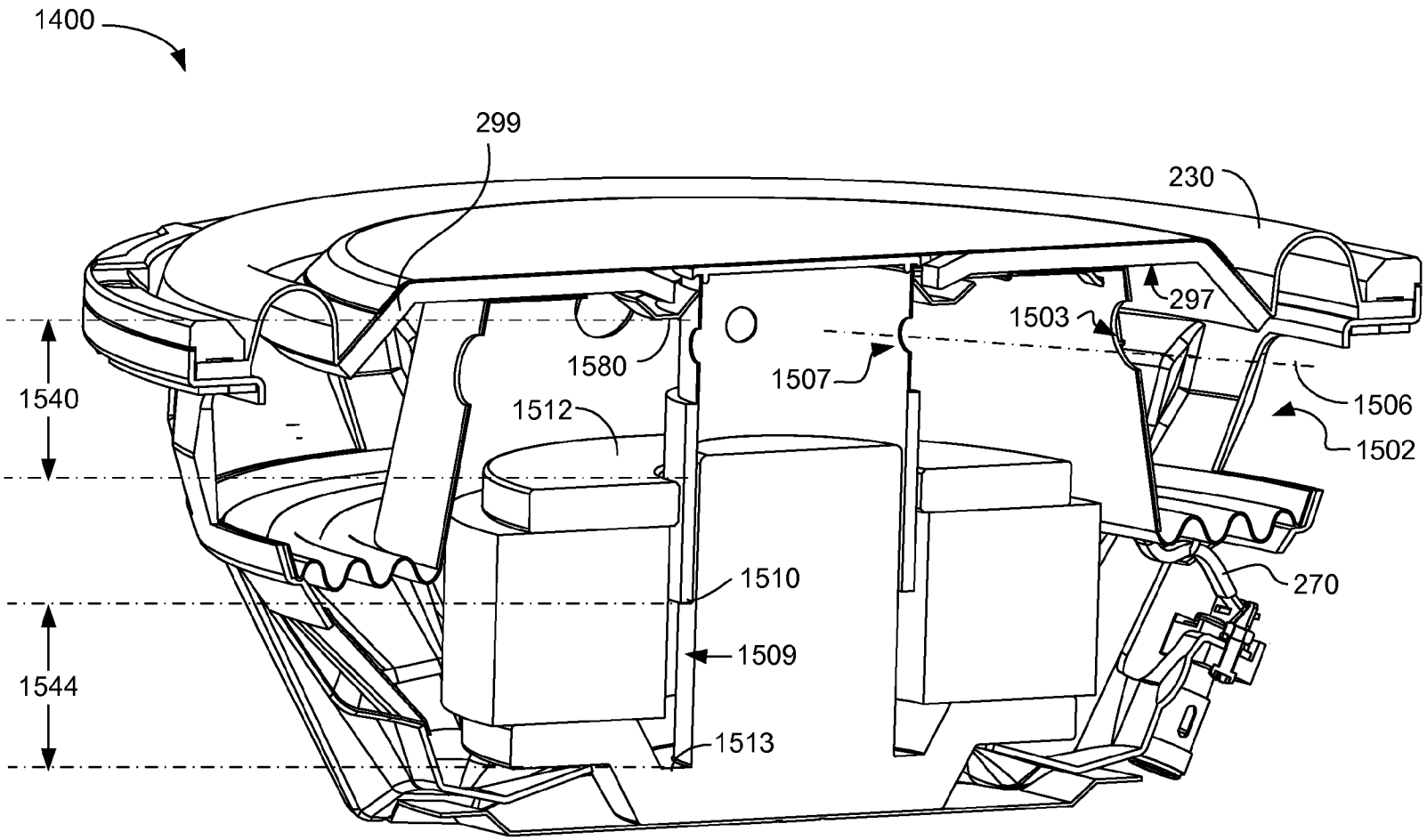
FIG. 15 is a perspective bisectional elevation view of the third exemplary embodiment of a shallow speaker of FIG. 14.

FIG. 15 is a perspective bisectional elevation view of the third exemplary embodiment of a shallow speaker 1400 of FIG. 14. Former vent 1507, opening 1503, and peripheral basket opening 1502 are aligned along axis 1506 in a quiescent state. Excursion 1540 between the bottom of radially outer circumferential adhesive well 1580 and the top of top piece 1512 is preferably equal to excursion 1544 between the bottom of voice coil 1510 and the floor 1513 of air gap 1509.

Although applicant has described applicant's preferred embodiments of this invention, it will be understood that the broadest scope of this invention includes modifications such as diverse shapes, sizes, and materials. For example, and without limitation, the teachings of this disclosure may be applied to speakers of various shapes and sizes. Such scope is limited only by the below claims as read in connection with the above specification. Further, many other advantages of applicant's invention will be apparent to those skilled in the art from the above descriptions and the below claims.

What is claimed is:

1. A shallow speaker that can be assembled to employ a magnet assembly having a longitudinal axis and radial symmetry about such longitudinal axis, such magnet assembly having a magnet assembly maximum radius, said shallow speaker comprising a spidercone, wherein said spidercone comprises:

a. a spider portion further comprising; a plurality of rolls; and a tangential radially outer circumferential attachment flange terminating an outermost roll of said plurality of rolls; and b. a frustroconical subcone portion formed integrally with said spider portion as a single composite piece.

2. The shallow speaker of claim 1, wherein said frustroconical subcone portion comprises:

a. a right frustroconical web, further comprising:

i. a front circular end having a front-end radius;

ii. a rear circular end having a rear-end radius, wherein said front-end radius is smaller than said rear-end radius; and iii. a radially outer surface: and b. a flexible annular portion:

i. integral with said front circular end;

ii. interior to said front circular end;

iii. partially closing said front circular end;

iv. having a rear annular surface and a front annular surface; and v. having an inner radius that is the minimum radius of said frustroconical subcone portion and is the spidercone minimum radius, wherein said spidercone minimum radius is less than such magnet assembly maximum radius;

c. wherein said spider portion, said right frustroconical web, and said annular portion are not made integral by connecting any two of said spider portion, said right frustroconical web, and said annular portion.

3. The shallow speaker of claim 1, wherein said right frustroconical web comprises a half-cone angle of at least three degrees.

4. The shallow speaker of claim 1, wherein said right frustroconical web comprises a plurality of openings.

5. The shallow speaker of claim 1, wherein said tangential radially outer circumferential attachment flange is tangential to said outermost roll.

6. The shallow speaker of claim 1, further comprising a tinsel, wherein said spider portion comprises a spider tinsel opening sized, shaped, and arranged to permit said tinsel to be threaded through said spider tinsel opening.

7. The shallow speaker of claim 1, wherein said spider portion comprises a tangential radially outer circumferential attachment flange, said shallow speaker comprising a basket sized, shaped, and arranged to couple to said spidercone and to support said spidercone, said basket having an interior basket surface portion inclined to be parallel to said tangential radially outer circumferential attachment flange when said spidercone is coupled to said basket.

8. The shallow speaker of claim 1, further comprising:
a. a substantially flat annular diaphragm having a diaphragm front surface and a diaphragm rear surface; and
b. a surround, supported by a basket having peripheral basket openings, wherein said surround comprises a front edge defining a surround front edge plane and wherein said diaphragm is positioned, in a quiescent state of said shallow speaker, to have said diaphragm front surface substantially coplanar with said surround front edge plane.

9. The shallow speaker of claim 8, wherein:
a. said diaphragm has an integral and radially outer circumferential diaphragm flange angled rearward from said diaphragm front surface at a first angle;
b. said surround further comprises a radially inner surround flange angled forward from a plane parallel to said diaphragm front surface at said first angle to be substantially parallel to said radially outer circumferential diaphragm flange; and
c. said radially outer circumferential diaphragm flange and said radially inner surround flange are operable to be adhesively coupled.

10. The shallow speaker of claim 8, further comprising:
a. a former, coaxially aligned with such magnet assembly, said former comprising:
i. a front end; and
ii. vents alignable to openings in said frustroconical subcone portion and further alignable to said peripheral basket openings; and
b. a radially outer circumferential adhesive well fixed to said former proximate said front end.

11. The shallow speaker of claim 10, wherein said spidercone comprises a radially inner circumferential spidercone flange angled rearward at a second angle, said radially inner circumferential spidercone flange sized, shaped, and arranged to extend into said circumferential adhesive well.

12. The shallow speaker of claim 10, wherein said annular diaphragm has an integral and radially inner circumferential diaphragm flange angled rearward from said diaphragm front surface at a second angle, and sized, shaped, and arranged to extend into said circumferential adhesive well.

13. The shallow speaker of claim 12, wherein said spidercone comprises a flexible annular portion having a front annular surface, said shallow speaker comprising at least a portion of said front annular surface coupled to at least a portion of said diaphragm rear surface.

14. The shallow speaker of claim 2, wherein said spidercone comprises:
a. a spider tinsel opening;
b. a cone tinsel opening; and
c. a tinsel interwoven through said spidercone, further comprising:
i. an extension of said tinsel through said spider tinsel opening and over a portion of said radially outer surface of said right frustroconical web;
ii. a further extension of said tinsel radially inward through said cone tinsel opening, proximate said rear annular surface of said flexible annular portion; and
iii. a further extension of said tinsel a distance sufficient to allow for said tinsel to be physically coupled to a former and electrically coupled to a voice coil coupled to said former.

15. The shallow speaker of claim 14, further comprising:
a. a first tinsel portion affixed to said portion of said radially outer surface of said right frustroconical web; and
b. a second tinsel portion affixed to a portion of said rear annular surface of said annular portion of said spidercone.

16. A shallow speaker comprising:
a. a magnet assembly having a longitudinal axis and radial symmetry about said longitudinal axis, said magnet assembly comprising a magnet assembly maximum radius, a magnet, and an air gap;
b. a former, comprising:
i. a right circular cylindrical web;
ii. a front end;
iii. vents; and
iv. a rear portion;
c. a circumferential adhesive well, wherein said circumferential adhesive well is one of affixed to said former proximate said front end and integral with said former proximate said front end, and further wherein said rear portion of said former is at least partially positionable within said air gap;
d. a spidercone oriented coaxially with said magnet assembly, wherein said spidercone comprises:
i. a spider portion; and
ii. a frustroconical subcone portion formed integrally with said spider portion;
e. a substantially flat annular diaphragm oriented coaxially with said magnet assembly and further comprising:
i. a diaphragm front surface;
ii. a diaphragm rear surface;
iii. an integral and radially outer circumferential diaphragm flange angled rearward from said diaphragm front surface at a first angle;
iv. an integral and radially inner circumferential diaphragm flange:
1. angled rearward from said diaphragm front surface at a second angle;
2. sized, shaped, and arranged to extend into said circumferential adhesive well; and
3. having a notch sized, shaped, and arranged to allow a tinsel to be threaded through said notch;
f. a surround, comprising:
i. a front edge defining a surround front edge plane, wherein said diaphragm is positioned, in a quiescent state of said shallow speaker, to have said diaphragm front surface substantially coplanar with said surround front edge plane; and
ii. a radially inner surround flange angled forward from a plane parallel to said diaphragm front surface at said first angle to be substantially parallel to said radially outer circumferential diaphragm flange; and
g. a basket supporting said magnet assembly, said spidercone, and said surround.

17. The shallow speaker of claim 16, wherein said spidercone comprises:
a. said spider portion, comprising:

i. a plurality of rolls, further comprising an outermost roll and an innermost roll, wherein said innermost roll terminates tangential to said right frustroconical web;

ii. a tangential radially outer circumferential attachment flange integral with and terminating said outermost roll of said plurality of rolls, said tangential radially outer circumferential attachment flange extending tangentially from said outermost roll; and iii. a spider tinsel opening;

b. said frustroconical subcone portion formed integrally with said spider portion, said frustroconical subcone portion further comprising:

i. a right frustroconical web, further comprising:

1. a front circular end having a front-end radius;

2. a rear circular end having a rear-end radius, wherein:

a. said front-end radius is smaller than said rear-end radius; and b. said rear-end radius is larger than said magnet assembly maximum radius; and 3. a radially outer surface having a cone tinsel opening; and ii. a flexible annular portion:

1. integral with said front circular end;

2. interior to said front circular end;

3. partially closing said front circular end;

4. having a rear annular surface and a front annular surface; and 5. having an inner radius that is concurrently:

a. a minimum radius of said frustroconical subcone portion and;

b. a spidercone minimum radius, wherein said spidercone minimum radius is less than said magnet assembly maximum radius;

iii. wherein said spider portion, said right frustroconical web, and said annular portion are not made integral by connecting said spider portion, said right frustroconical web, and said annular portion.

18. The shallow speaker of claim 16, wherein said spider portion comprises:

a. a tangential radially outer circumferential attachment flange;

b. a basket sized, shaped, and arranged to couple to said spidercone and to support said spidercone, said basket having an interior basket surface portion inclined to be parallel to said tangential radially outer circumferential attachment flange when said spidercone is coupled to said basket.

19. The shallow speaker of claim 16, wherein said spidercone comprises at least one opening in said right frustroconical web.

20. A shallow speaker comprising the combination of:

a. a magnet assembly having a longitudinal axis and radial symmetry about said longitudinal axis, said magnet assembly having a magnet assembly maximum radius, a magnet, and an air gap;

b. a former, comprising:

i. a right circular cylindrical web;

ii. a front end;

iii. vents; and iv. a rear portion;

c. a circumferential adhesive well, affixed to said former, proximate said front end;

d. a spidercone oriented coaxially with said magnet assembly, wherein said spidercone comprises:

i. a spider portion, comprising:

1. a plurality of rolls;

2. a tangential radially-outer circumferential attachment flange terminating an outermost roll of said plurality of rolls; and 3. a spider tinsel opening; and ii. a frustroconical subcone portion formed integrally with said spider portion, wherein said frustroconical subcone portion comprises:

1. a right frustroconical web, further comprising:

a. a front circular end having a front-end radius;

b. a rear circular end having a rear-end radius, wherein:

i. said front-end radius is smaller than said rear-end radius; and ii. said rear-end radius is larger than said magnet assembly maximum radius;

c. a half cone angle of at least three degrees; and d. at least one opening; and 2. a flexible annular portion:

a. integral with said front circular end;

b. interior to said front circular end;

c. partially closing said front circular end; and d. having an inner radius that is the minimum radius of said frustroconical subcone portion and is the spidercone minimum radius, wherein said minimum radius of said frustroconical subcone portion is less than said magnet assembly maximum radius;

iii. wherein said spider portion and said frustroconical subcone portion, including said right frustroconical web and said flexible annular portion, are formed together as a single piece and are not made integral by connecting said spider portion, said right frustroconical web, and said annular portion;

e. a substantially flat annular diaphragm oriented coaxially with said magnet assembly and having a diaphragm front surface and a diaphragm rear surface;

f. a surround oriented coaxially with said magnet assembly and having:

i. a front edge defining a surround front edge plane, and ii. a radially inner surround flange angled forward from a plane parallel to said diaphragm front surface at said first angle to be substantially parallel to said radially outer circumferential diaphragm flange;

g. wherein said annular diaphragm is supported by said surround and by said spidercone, in a quiescent state position, with said diaphragm front surface substantially coplanar with said surround front edge plane; and h. a basket supporting said magnet assembly, said spidercone, and said surround, wherein said basket is sized, shaped, and arranged to couple to said spidercone and to support said spidercone, said basket having:

i. an interior basket surface portion inclined to be parallel to said tangential radially outer circumferential attachment flange when said spidercone is coupled to said basket; and ii. at least one peripheral opening.

* * * * *